US005968880A

United States Patent [19]

Mathur et al.

[11] Patent Number: 5,968,880

[45] Date of Patent: Oct. 19, 1999

[54] LUBRICATING COMPOSITIONS, FUNCTIONAL FLUIDS AND GREASES CONTAINING THIOPHOSPHORUS ESTERS OR THEIR SALTS WITH A OXYALKYLENE GROUP, AND METHODS OF USING THE SAME

[75] Inventors: Naresh Chand Mathur, Highland Heights; Mary Galic Raguz, Mentor, both of Ohio

[73] Assignee: The Lubrizol Corporation, Wickliffe, Ohio

[21] Appl. No.: 08/956,083

[22] Filed: Oct. 23, 1997

[51] Int. Cl.[6] ..... C10M 137/04

[52] U.S. Cl. ..... 508/431; 508/429; 508/436

[58] Field of Search ..... 508/429, 431

[56] References Cited

U.S. PATENT DOCUMENTS

| | | | |
|---|---|---|---|
| 2,905,683 | 9/1959 | Goldsmith | 260/429.7 |
| 3,214,423 | 10/1965 | Zech | 260/97.5 |
| 3,337,654 | 8/1967 | Cyba | 260/950 |
| 3,340,329 | 9/1967 | Guarnaccio et al. | 260/925 |
| 3,359,347 | 12/1967 | Cyba | 260/925 |
| 4,044,032 | 8/1977 | Wiley et al. | 260/399 |
| 4,259,192 | 3/1981 | Lilburn | 252/32.7 |
| 4,526,697 | 7/1985 | Cox | 252/75 |
| 4,579,672 | 4/1986 | Brecker et al. | 252/49.8 |
| 4,599,191 | 7/1986 | Horodysky | 508/431 |
| 4,814,097 | 3/1989 | Cardis | 252/46.6 |
| 4,997,968 | 3/1991 | Burjes et al. | 558/120 |
| 5,342,531 | 8/1994 | Walters et al. | 252/32.5 |
| 5,567,341 | 10/1996 | Tury | 508/436 |
| 5,622,923 | 4/1997 | Mathur et al. | 508/431 |

FOREIGN PATENT DOCUMENTS

| | | |
|---|---|---|
| 523561 | 7/1992 | European Pat. Off. . |
| 551760 | 12/1992 | European Pat. Off. . |
| 9403462 | 2/1994 | WIPO . |

OTHER PUBLICATIONS

Smalheer, C.V. and R.K. Smith; Lubricant Additives; Lezius–Hiles Co., Cleveland, Ohio, Mar. 1967.

EP 96 30 4409; European Search Report mailed Jul. 2, 1997.

*Primary Examiner*—Ellen M. McAvoy
*Attorney, Agent, or Firm*—Renner, Otto, Boisselle & Sklar

[57] ABSTRACT

This invention relates to a lubricating composition comprising a major amount of an oil of lubricating viscosity and at least one metal-free thiophosphorus acid ester, at least one amine salt of the thiophosphorus acid ester, or a mixture thereof, wherein the thiophosphorus acid ester contains at least one hydrocarbyl terminated oxyalkylene group, at least one hydrocarbyl terminated polyoxyalkylene group, or a mixture thereof. In one embodiment, the thiophosphorus acid ester is a thiophosphorus acid ester represented by the following formula $$(R_1-(OR_2)_x-X_2)_{3-a}-\overset{\overset{X_1}{\|}}{P}-(X_3R_3)_a$$

wherein $X_1$, $X_2$, and $X_3$ are oxygen or sulfur, provided that at least one of $X_1$, $X_2$, and $X_3$ is sulfur; $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester. The lubricating compositions, functional fluids and greases have improved antiwear/extreme pressure properties and improved antioxidation properties. In functional fluids, the thiophosphorus acid esters and their salts act as antiwear agents and rust inhibitors.

33 Claims, No Drawings

LUBRICATING COMPOSITIONS, FUNCTIONAL FLUIDS AND GREASES CONTAINING THIOPHOSPHORUS ESTERS OR THEIR SALTS WITH A OXYALKYLENE GROUP, AND METHODS OF USING THE SAME

TECHNICAL FIELD OF THE INVENTION

This invention relates to lubricating compositions and grease which contain a metal free thiophosphorus acid ester or salts thereof which contain at least one hydrocarbyl terminated oxyalkylene group and methods of using the same.

BACKGROUND OF THE INVENTION

An ongoing problem in the area of lubricating machinery is improving the lubricants ability to prevent metal-on-metal contact. Previously, phosphorus esters were used, often in combination with other additives, to provide antiwear and extreme pressure protection to lubricants. Additionally, today the design of equipment has forced the operation temperatures into higher regions. These increased temperatures in combination with oxygen may oxidize the lubricant. It would be advantageous to have additives which improve the antiwear and extreme pressure protection of the lubricant while also providing good antioxidation protection.

U.S. Pat. No. 2,905,683, issued to Goldsmith, relates to ether containing esters of dithiophosphoric acids and salts thereof. The dithiophosphric acid esters have ether containing radicals.

U.S. Pat. No. 3,214,423, issued to Zech et al, relates to thiophosphates of polyoxyethylene compounds. The thiophosphates are derived from the reaction of polyoxyethylene derivatives of fatty alcohols, fatty amines, fatty amides, fatty acids, hydroxy esters of fatty acids and alkyl phenols having from about 8 to about 18 carbon atoms in the alkyl chain. The thiophosphates are water soluble and are useful as an aqueous coolant for metal cutting.

U.S. Pat. No. 4,044,032, issued to Wiley et al, relates to metal dialkyl dithiophosphates. The dialkyldithiophosphates are prepared from oxyalkylated long straight chain alcohols, acid, and mercaptans. These materials are useful in lubricants such as automatic transmission fluids.

U.S. Pat. No. 4,579,672, issued to Brecker et al, relates to functional fluids and lubricants with improved water tolerance by including alkoxypolyethyleneoxy acid phosphite ester additives.

U.S. Pat. No. 5,342,531, issued Walters et al, relates to polyalkylene glycol lubricants compositions. The lubricants include (a) sulfur containing antiwear or extreme pressure agent, (b) an amine salt of a partially esterified monothiophosphoric acid, and (c) an amine salt of a partially esterified phosphoric acid.

SUMMARY OF THE INVENTION

This invention relates to a lubricating composition comprising a major amount of an oil of lubricating viscosity and at least one metal-free thiophosphorus acid ester, at least one amine salt of the thiophosphorus acid ester, or a mixture thereof, wherein the thiophosphorus acid ester contains at least one hydrocarbyl terminated oxyalkylene group, at least one hydrocarbyl terminated polyoxyalkylene group, or a mixture thereof. In one embodiment, the lubricating composition comprises a major amount of an oil of lubricating viscosity and at least one monthiophosphorus compound selected from the group consisting of a metal-free monothiophosphorus acid ester, an amine salt of the monothiophosphorus acid ester, and mixture thereof, wherein the monothiophosphorus compound contains at least one hydrocarbyl terminated oxyalkylene group or at least one hydrocarbyl terminated polyoxyalkylene group, or at least one. In one embodiment, the thiophosphorus acid ester is a thiophosphorus acid ester represented by the following formula $$(R_1 - (OR_2)_x - X_2)_{3-a} - \overset{X_1}{\overset{\|}{P}} - (X_3R_3)_a$$

wherein $X_1$, $X_2$, and $X_3$ are oxygen or sulfur, provided that at least one of $X_1$, $X_2$, and $X_3$ is sulfur; $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester. The lubricating compositions, functional fluids and greases have improved antiwear/extreme pressure properties and improved antioxidation properties. In functional fluids, the thiophosphorus acid esters and their salts act as antiwear agents and rust inhibitors.

DESCRIPTION OF THE PREFERRED EMBODIMENTS

The term "hydrocarbyl" includes hydrocarbon as well as substantially hydrocarbon groups. Substantially hydrocarbon describes groups which contain heteroatom substituents that do not alter the predominantly hydrocarbon nature of the substituent. Examples of hydrocarbyl groups include the following:

(1) hydrocarbon substituents, i.e., aliphatic (e.g., alkyl or alkenyl) and alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) heteroatom substituents, i.e., substituents which will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen and such substituents as, e.g. pyridyl, furyl, thienyl, imidazolyl, etc.

In general, no more than about 2, preferably no more than one heteroatom substituent will be present for every ten carbon atoms in the hydrocarbyl group. Typically, there will be no such heteroatom substituents in the hydrocarbyl group. Therefore, the hydrocarbyl group is hydrocarbon.

The thiophosphorus acid ester is generally present in an amount to improve the antiwear or extreme pressure properties of the lubricants, functional fluids or greases. In one embodiment, the thiophosphorus acid ester is present in an amount from about 0.01% up to about 10%, or from about 0.05% or up to about 4%, or from about 0.08% up to about 3%, or from 0.1% to about 2% by weight. Here, as well as elsewhere in the specification and claims, the range and ratio limits may be combined.

Thiophosphorus Acid Esters

As described above, the thiophosphorus acid ester has at least one group which is a hydrocarbyl terminated oxyalkylene group, or salts thereof. In one embodiment, the thiophosphorus acid esters are free of metal, e.g. ashless. The thiophosphorus acid esters or their salts may have one, two or three hydrocarbyl terminated oxyalkylene groups,. Preferably, the thiophosphorus acid esters or salts have one or two, more preferably two hydrocarbyl terminated oxyalkylene groups, or a mixture of compounds having one, two or three hydrocarbyl terminated oxyalkylene groups. In one embodiment, the thiophosphorus acid esters are free of dithiophosphorus acid esters.

The hydrocarbyl moiety of the hydrocarbyl terminated oxyalkylene group generally contains up to about 30, or up to about 24, or up to about 18 carbon atoms. The hydrocarbyl moiety typically contains at least 1, or at least about 6, or at least about 8 carbon atoms. Examples of hydrocarbyl moieties include octyl, nonyl, decyl, dodecyl, tridecyl, tetradecyl, pentadecyl, hexadecyl, heptadecyl, octadecyl, nonadecyl, eicosyl, docosyl, tetracosyl, etc. In one embodiment, the hydrocarbyl moiety is free of sulfur. In another embodiment, the hydrocarbyl moiety is aliphatic.

The oxyalkylene moiety typically contains from 1 to about 18 carbon atoms, preferably from about 2 to about 8, more preferably two or three carbon atoms. The hydrocarbyl terminated oxyalkylene group may contain from one to about 40 oxyalkylene moieties. In one embodiment, the hydrocarbyl terminated oxyalkylene group has from about 2 to about 15, or from about 2 to about 10 or two or three oxyalkylene moieties. In one embodiment, the number of oxyalkylene groups is an average. In one embodiment, the oxyalkylene groups are derived from alkylene oxides, such as those described herein (e.g. ethylene oxide, propylene oxide, butylene oxide, etc.)

Hydrocarbyl terminated oxyalkylene groups are derived from hydrocarbyl terminated oxyalkylenes. The hydrocarbyl terminated oxyalkylene may be prepared by treatment of a alcohol, a phenol, an amine, such as those discussed below, including the monoamines, or a mercaptan, such as $C_{1-30}$ or $C_{1-18}$ mercaptans, with at least one alkylene oxide, preferably an alkylene oxide having from one to about eight carbon atoms. Examples of alkylene oxides include ethylene oxide, propylene oxide, and butylene oxide. Preferably the hydrocarbyl terminated oxyalklyene is an alkyl terminated oxyalkylene. The alkyl terminated polyoxyalkylenes are available commercially under such trade names as "CARBOWAX®" and "TERGITOL®" from Union Carbide, "TRITON®" from Rohm & Haas Company, "ALFONIC®" from Vista Chemicals Company, "GENEPOL®" from Hoechst Celanese Corporation, and "NEODOL®" from Shell Chemical Company. The TERGITOLS are identified as polyethylene glycol ethers of primary or secondary alcohols. Particularly preferred TERGITOL alkyl terminated oxyalkylenes are the TERGITOL® 15-S Series of secondary polyethylene glycol ethers. Examples of this series include TERGITOL 15-S-3, TERGITOL 15-S-5, TERGITOL 15-S-7, TERGITOL 15-S-9, TERGITOL 15-S-12, TERGITOL 15-S-15, TERGITOL 15-S-20, TERGITOL 15-S-30, and TERGITOL 15-S-40, wherein the last number of the series refers the average number of oxyethylene moieties in the ethers. The GENAPOL ethoxylated alcohols are synthetic or natural linear alcohols which are treated with ethylene oxide. An example of one of these alcohols is GENAPOL® 24-L-3, which is a $C_{12-14}$ synthetic alcohol treated with about three moles of ethylene oxide. The TRITON materials are identified generally as polyethoxylated alcohols or phenols. The ALFONIC materials are identified as ethoxylated linear alcohols which may be represented by the general structural formula, $$CH3(CH2)_dCH2(OCH2CH2)_eOH,$$

wherein d varies between 4 and 16 and e is a number between about 3 and about 11. Specific examples of ALFONIC® ethoxylates characterized by the above formula include ALFONIC 1012-60 wherein d is about 8 to 10 and e is an average of about 5 to 6; ALFONIC 1214-70 wherein d is about 10–12 and e is an average of about 10 to about 11; ALFONIC 1412-40, wherein d is about 10–12 and e is an average of about 2.5; ALFONIC 1412-60 wherein d is from 10–12 and e is an average of about 7; and ALFONIC 1218-70 wherein d is about 10–16 and e is an average of about 10 to about 11.

The NEODOL® ethoxylates are ethoxylated alcohols wherein the alcohols are a mixture of alcohols containing from about 12 to about 15 carbon atoms, and the alcohols are partially branched chain primary alcohols. The ethoxylates are obtained by reacting the alcohols with an excess of ethylene oxide, such as from about 3 to about 12 or more moles of ethylene oxide per mole of alcohol. For example, NEODOL ethoxylate 23-6.5 is a partially branched chain alcoholate of 12 to 13 carbon atoms with an average of about 6 to about 7 ethoxy units.

In one embodiment, the metal-free thiophosphorus acid ester represented by the following formula $$(R_1 — (OR_2)_x — X_2)_{3-a} — \overset{\overset{X_1}{\|}}{P} — (X_3R_3)_a$$

wherein $X_1$, $X_2$, and $X_3$ are oxygen or sulfur, provided that at least one of $X_1$, $X_2$, and $X_3$ is sulfur; $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester. In one embodiment, $X_1$ is sulfur, and $X_2$ and $X_3$ are oxygen and a is one. $R_1$ and $R_3$ each independently the same as the description of the hydrocarbyl moiety above. The values for x are the same the number of oxyalkylene groups described above.

In one embodiment, thiophosphorus acid ester is represented by the following formula $$R_1 — (OR_2)_x — O)_{3-a} — \overset{\overset{S}{\|}}{P} — (OR_3)_a$$

wherein $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester. $R_1$, $R_2$, and $R_3$ are described above.

The thiophosphorus acid ester contains at least one hydrocarbyl terminated oxyalkylene group may be prepared by transesterifying a phosphite with one or more oxyalkylene containing compounds. In one embodiment, the thiophosphorus acid esters are prepared in the absence of unsaturated fatty acids or esters. The resulting intermediate is reacted with sulfur or a sulfur source. The phosphite may be a di- or trihydrocarbyl phosphite. Preferably each hydrocarbyl group contains from 1 to about 24 carbon atoms, more preferably from 1 to about 18 carbon atoms, and more preferably from 1 to about 8 carbon atoms. Each hydrocarbyl group may be independently alkyl, alkenyl, or aryl, preferably alkyl.

The sulfur source may be any of a variety of materials which are capable of supplying sulfur to the reaction. Examples of useful sulfur sources include sulfur, sulfur halides, combinations of sulfur with hydrogen sulfide or sulfur oxide with hydrogen sulfide, and various sulfur containing organic compounds. Elemental sulfur is a preferred sulfur source. The sulfur halides include sulfur monochloride, sulfur dichloride, etc. The sulfur sources may also be sulfur containing organic compounds, such as aromatic and alkyl sulfides, dialkenyl sulfides, sulfurized olefins, sulfurized oils, sulfurized fatty acid esters, sulfurized aliphatic esters of olefinic mono- or dicarboxylic acids, diester sulfides, sulfurized Diels-Alder adducts and sulfurized terpenes. U.S. Pat. No. 4,755,311 discloses various sulfur sources capable of supplying sulfur to reaction. This patent is incorporated by reference for its disclosure of sulfur sources. The preparation of monothiophosphoric acid esters is disclosed in U.S. Pat. No. 4,755,311 and PCT Publication WO 87/07638, which are incorporated herein by reference for their disclosure of monothiophosphoric acids, sulfur sources, and the process for making monothiophosphoric acid esters.

As described above, salts of the thiophosphorus acid esters having a hydrocarbyl terminated oxyalkylene group may be used in lubricants. The salts are formed by reacting the thiophosphorus acid ester with ammonia or an amine to form a salt. The salts may be formed separately and then the salt of the thiophosphorus acid ester may be added to the lubricating composition. Alternatively, the salts may also be formed in situ when the acidic thiophosphorus acid ester is blended with other components to form a fully formulated lubricating composition. The phosphorus acid ester could then form salts with basic materials which are in the lubricating composition or functional fluid composition such as basic nitrogen containing compounds (e.g., basic nitrogen containing dispersants).

The amine salts of the thiophosphorus acid esters may be formed from ammonia, or a primary, secondary or tertiary amine, or mixtures thereof. These amines can be monoamines or polyamines. Useful amines include those disclosed in U.S. Pat. No. 4,234,435 at Col. 21, line 4 to Col. 27, line 50, this section of this reference being incorporated herein by reference.

The monoamines generally contain from 1 to about 24 carbon atoms, with from 1 to about 12 carbon atoms being preferred, with from 1 to about 6 being more preferred. Examples of monoamines include methylamine, ethylamine, propylamine, butylamine, octylamine, and dodecylamine. Examples of secondary amines include dimethylamine, diethylamine, dipropylamine, dibutylamine, methylbutylamine, ethyl-hexylamine, etc. Tertiary amines include trimethylamine, tributylamine, methyidiethylamine, ethyldibutylamine, etc.

In one embodiment, the amine may be a hydroxyamine. Typically, the hydroxyamines are primary, secondary or tertiary alkanol amines or mixtures thereof. Such amines can be represented by the formulae: $H_2$—N—R'—OH, H($R'_1$)N—R'—OH, and $(R'_1)_2$—N—R'—OH, wherein each $R'_1$ is independently a hydrocarbyl group having from one to about eight carbon atoms or hydroxyhydrocarbyl group having from one to about eight carbon atoms, or from one to about four, and R' is a divalent hydrocarbyl group of about two to about 18 carbon atoms, or from two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. Where two $R'_1$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R'_1$ is independently a methyl, ethyl, propyl, butyl, pentyl or hexyl group. Examples of these alkanolamines include mono-, di-, and triethanolamine, diethylethanolamine, ethylethanolamine, butyldietha-nolamine, etc.

The hydroxyamines may also be an ether N-(hydroxyhydrocarbyl)amine. These are hydroxypoly (hydrocarbyloxy) analogs of the above-described hydroxyamines (these analogs also include hydroxyl-substituted oxyalkylene analogs). Such N-(hydroxyhydrocarbyl) amines can be conveniently prepared by reaction of one or more of the above epoxides with above described amines and may be represented by the formulae: $H_2N$—$(R'O)_x$—H, H($R'_1$)N—$(R'O)_x$—H, and $(R'_1)_2N$—$(R'O)_x$—H, wherein x is a number from about 2 to about 15 and $R_1$ and R' are as described above. $R'^1$ may also be a hydroxypoly(hydrocarbyloxy) group.

In another embodiment, the amine is a hydroxyamine which may be represented by the formula

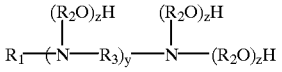

wherein $R_1$ is a hydrocarbyl group containing from about 6 to about 30 carbon atoms; $R_2$ is an alkylene group having from about two to about twelve carbon atoms, preferably an ethylene or propylene group; $R_3$ is an alkylene group containing from 1 up to about 8, or from 1 up to about 5 carbon atoms; y is zero or one; and each z is independently a number from zero to about 10, with the proviso that at least one z is zero.

Useful hydroxyhydrocarbyl amines where y in the formula is zero include 2-hydroxyethylhexylamine; 2-hydroxyethyloctylamine; 2-hydroxyethylpentadecylamine; 2-hydroxyethyloleylamine; 2-hydroxyethylsoyamine; bis(2-hydroxyethyl)hexylamine; bis(2-hydroxyethyl)oleylamine; and mixtures thereof. Also included are the comparable members wherein in the above formula at least one z is at least 2, as for example, 2-hydroxyethoxyethylhexylamine.

In one embodiment, the amine may be a hydroxyhydrocarbyl amine, where referring to the above formula, y equals zero. These hydroxyhydrocarbyl amines are available from the Akzo Chemical Division of Akzona, Inc., Chicago, Ill., under the general trade designations "ETHOMEEN" and "PROPOMEEN". Specific examples of such products include: ETHOMEEN C/15 which is an ethylene oxide condensate of a coconut fatty acid containing about 5 moles of ethylene oxide; ETHOMEEN C/20 and C/25 which are ethylene oxide condensation products from coconut fatty acid containing about 10 and 15 moles of ethylene oxide, respectively; ETHOMEEN O/12 which is an ethylene oxide condensation product of oleyl amine containing about 2 moles of ethylene oxide per mole of amine; ETHOMEEN S/15 and S/20 which are ethylene oxide condensation products with stearyl amine containing about 5 and 10 moles of ethylene oxide per mole of amine, respectively; ETHOMEEN T/12, T/15 and T/25 which are ethylene oxide condensation products of tallow amine containing about 2, 5 and 15 moles of ethylene oxide per mole of amine, respectively; and PROPOMEEN O/12 which is the condensation product of one mole of oleyl amine with 2 moles propylene oxide.

The amine may also be a polyamine. The polyamines include alkoxylated diamines, fatty polyamine diamines, alkylenepolyamines, hydroxy containing polyamines, condensed polyamines, and heterocyclic polyamines. Commercially available examples of alkoxylated diamines include those amines where y from above is one. Examples of these amines include ETHODUOMEEN T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylenediamines, propanediamines (1,2, or 1,3), and polyamine analogs of the above. Suitable commercial fatty polyamines are DUOMEEN C (N-coco-1,3-diaminopropane), DUOMEEN S (N-soya-1,3-diaminopropane), DUOMEEN T (N-tallow-1,3-diaminopropane), and DUOMEEN O (N-oleyl-1,3-diaminopropane). "DUOMEENS" are commercially available from Armak Chemical Co., Chicago, Ill.

The amine may be an alkylenepolyamine. Alkylenepolyamines are represented by the formula $H(R_1)N—(Alkylene—N)_n—(R_1)_2$, wherein each R1 is independently hydrogen; or an aliphatic or hydroxy-substituted aliphatic group of up to about 30 carbon atoms; n is a number from 1 to about 10, or from about 2 to about 7, or from about 2 to about 5; and the "Alkylene" group has from 1 to about 10 carbon atoms, or from about 2 to about 6, or from about 2 to about 4. In another embodiment, R1 is independently a hydrocarbyl group having from one to about eight carbon atoms or hydroxyhydrocarbyl group having from one to about eight, or from one to about four carbon atoms. Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl) amine, propylenediamine, trimethylenediamine, tripropylenetetramine, triethylenetetraamine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment, the polyamine is an ethylenepolyamine. Such polyamines are described in detail under the heading Ethylene Amines in Kirk Othmer's "Encyclopedia of Chemical Technology", 2d Edition, Vol. 7, pages 22–37, Interscience Publishers, New York (1965). Ethylenepolyamines are often a complex mixture of polyalkylenepolyamines including cyclic condensation products. Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylenepolyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetraamine, 21.74% tetraethylenepentaamine and 76.61% pentaethylenehexamine and higher analogs. These alkylenepolyamine bottoms include cyclic condensation products such as piperazine and higher analogs of diethylenetriamine, triethylenetetramine and the like. These alkylenepolyamine bottoms may be reacted solely with the acylating agent or they may be used with other amines, polyamines, or mixtures thereof.

In another embodiment, the polyamines are hydroxy-containing polyamines. Hydroxy-containing polyamine analogs of hydroxy monoamines, particularly alkoxylated alkylenepolyamines, e.g., N,N'-(dihydroxyethyl) ethylenediamines can also be used. Such polyamines can be made by reacting the above-described alkylene amines with one or more of the above-described alkylene oxides. Similar alkylene oxide-alkanol amine reaction products may also be used such as the products made by reacting the above described primary, secondary or tertiary alkanol amines with ethylene, propylene or higher epoxide in a 1.1 to 1.2 molar ratio. Reactant ratios and temperatures for carrying out such reactions are known to those skilled in the art. Specific examples of hydroxy-containing polyamines include N-(2-hydroxyethyl)ethylenediamine, N,N-bis(2-hydroxyethyl) ethylenediamine, 1-(2-hydroxyethyl)piperazine, mono (hydroxypropyl)-substituted tetraethylene-pentamine, N-(3-hydroxybutyl)tetramethylenediamine, etc. Higher homologs obtained by condensation of the above illustrated hydroxy-containing polyamines through amino groups or through hydroxy groups are likewise useful. Condensation through amino groups results in a higher amine accompanied by removal of ammonia, while condensation through the hydroxy groups results in products containing ether linkages accompanied by removal of water. Mixtures of two or more of any of the above described polyamines are also useful.

Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 or from two to about four carbon atoms. Examples of polyhydric amines include diethanolamine, triethanolamine, tri-(hydroxypropyl)amine, tris-(hydroxymethyl)amino methane, 2-amino-2-methyl-1,3-propanediol, N,N,N',N'-tetrakis (2-hydroxypropyl) ethylenediamine, and N,N,N',N'-tetrakis (2-hydroxyethyl) ethylenediamine, preferably tris (hydroxymethyl) aminomethane (THAM).

Polyamines which may react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually from about 60° C. to about 265° C., or from about 220° C. to about 250° C. in the presence of an acid catalyst.

The amine condensates and methods of making the same are described in PCT publication WO86/05501 and U.S. Pat. No. 5,230,714 (Steckel) which are incorporated by reference for its disclosure to the condensates and methods of making. A particularly useful amine condensate is prepared from HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and tris(hydroxymethyl) aminomethane (THAM).

In another embodiment, the polyamine is a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmor-pholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines may be used and include N-(2-hydroxyethyl)cyclohexylamine, 3-hydroxycyclopentylamine, parahydroxyaniline, N-hydroxyethylpiperazine, and the like.

The following Examples relates to thiophosphorus acid esters and their salts, as well as methods of making the same. Unless the context clearly indicates otherwise, the weight and the ratio are by weight, temperature is in degrees Celsius, and the pressure is atmospheric.

EXAMPLE 1

(a) A reaction vessel is charged with 705 grams (2.1 moles) of a polyethoxylated secondary $C_{11-15}$ alcohol, having an average of 3 oxyethylene groups and available commercially as TERGITOL® 15-S-3, and 177 grams (1.1 moles) of triethylphosphite. The mixture is heated to 135° C. and the temperature is maintained for 5 hours, while 43 grams of distillate are collected. The temperature is gradually raised to 190° over 8 hours, while 33 grams of distillate are collected. The reaction mixture is cooled to 150° C. and vacuum stripped to 200 mm Hg. The temperature is raised to 190° C. and the pressure is reduced to 35 mm Hg. A total of approximately 100 grams of distillate is collected. The residue is cooled to 80° C. and filtered through diatomaceous earth. The residue contains 4.2% phosphorus.

(b) The above phosphite (319 grams, 0.43 equivalents) is charged to a reaction vessel and heated to 140° C. under a nitrogen flow of 0.4 standard cubic foot per hour (SCFH). Sulfur (11.5 grams, 0.36 equivalents) is added portionwise over 30 minutes to the reaction vessel, while maintaining the temperature at 140–145° C. The temperature is maintained for 2 hours at 145° C. The reaction mixture is cooled to 50° C. and filtered through diatomaceous earth. The filtrate has 4.0% phosphorus and 3.8% sulfur. The product has a 1B copper strip at 100° C. for 3 hours.

EXAMPLE 2

A reaction vessel is charged with the polyethoxylated alcohol of Example 1 (2500 grams, 7.53 equivalents) and triethylphosphite (626 grams, 3.77 equivalents). The reaction mixture is blown with nitrogen at less than 0.1 SCFH, and is heated to 145–150° C., while 148 grams of distillate are collected over 6–8 hours. The temperature is raised to 190° C. at a rate of approximately 10° C. per hour and is maintained for 1 hour, while additional distillate (105 grams) is collected. The reaction mixture is cooled to 160° C. and the reaction mixture is stripped to 200 mm Hg at 160° C. for 2 hours. The temperature is raised to 190° C. and maintained for 1 hour, while the pressure is reduced to 35 mm Hg. Vacuum is released and the residue is cooled to 135–140° C. Sulfur (100 grams, 3.13 equivalents) is added portionwise over 2 hours while maintaining the temperature between 135–145° C. The reaction mixture is heated to 145° C. and the temperature is maintained for 2 hours. The reaction mixture is cooled to 50° C. and the product is filtered through diatomaceous earth. The filtrate is the desired product, which has 4.2% phosphorus and 3.7% sulfur.

EXAMPLE 3

A reaction vessel is charged with 340 grams (0.67 equivalents) of a polyethoxylated secondary $C_{11-15}$ alcohol, and having an average of 7 oxyethylene groups, reacted with 56 grams (0.33 equivalents) of triethylphosphite. The reaction mixture is heated to 190° C. over 4 hours and a temperature is maintained at 190° C. for an additional 2 hours while 20 grams of distillate are collected. The reaction mixture is vacuum stripped to 25 mm at 190° C. for 1 hour, while 8 grams of distillate are collected. The residue is filtered through diatomaceous earth. The filtrate is the desired product and has 2.7% phosphorus and a 1A copper strip at 100° C. for 3 hours.

The above phosphite (0.43 equivalents) is reacted with (0.36 equivalents) of sulfur as described in Example 1.

EXAMPLE 4

A reaction vessel is charged with 400 grams (1.2 moles) of a polyethoxylated linear $C_{10-12}$ alcohol, having an average of 2.5 oxyethylene groups. Triethylphosphite (105 grams, 0.6 moles) is added to the reaction vessel and the mixture is heated to 145–150° C. The temperature is maintained for 3 hours under a sub-surface nitrogen inlet of less than 0.1 SCFH, while 25 grams of distillate are collected. The temperature is raised 10° per hour to a final temperature of 190° C. The temperature is maintained at 190° C. for 1 hour, while 41 grams of distillate are collected. The reaction mixture is cooled to 160° C. and vacuum stripped to 240 mm Hg at 190° C. The residue is cooled to 140° C. and the vacuum is released. Sulfur (17 grams, 0.53 equivalents) is added portionwise over 1 hour. The reaction temperature is maintained at 145° C. for 30 minutes. The reaction mixture is cooled and it is the desired product, which has 4.1% phosphorus and 5.6% sulfur.

EXAMPLE 5

A reaction vessel is charged with 365 grams (2.2 moles) of triethylphosphite. The contents are heated to 130° C. where 664 grams of the polyethoxylated alcohol of Example 1 is added dropwise. When about 150 milliliters of the alcohol are added, the temperature is increased to 150° C. The addition is finished in four hours. The reaction temperature is maintained for eight hours. The reaction is vacuum stripped to 20 mm Hg and 135–140° C. A total of 200 grams of distillate is collected after vacuum. Sulfur (52 grams, 1.63 moles) is added over two hours at 145° C. The reaction temperature is maintained for two hours and contents are filtered through diatomaceous earth. The filtrate is the desired product and has 5.5% phosphorus and 6.0% sulfur.

EXAMPLE 6

A reaction vessel is charged with 1500 grams (4.5 moles) of the polyethoxylated alcohol of Example 1. The contents are heated to 180° C. where 250 grams (1.5 moles) of triethylphosphite is added dropwise over six hours. The reaction temperature is maintained at 180° C. for two hours. The reaction mixture was vacuum stripped to 20 mm Hg and 200° C. A total of 171 grams of distillate is collected. The reaction mixture is cooled to 135° C. and sulfur (43 grams, 1.34 moles) is added while keeping the temperature below 145° C. The reaction temperature is maintained for one hour at 145° C. and the contents are filtered through diatomaceous earth. The filtrate is the desired product and has 2.7% phosphorus and 2.6% sulfur.

EXAMPLE 7

A reaction vessel is charged with 450 grams (1.59 moles) of a ethoxylated branch chain primary $C_{9-11}$ alcohol, having an average of 2.5 oxyethylene groups and 134 grams (0.81 moles) of triethylphosphite. The mixture is heated to 150° C. and the temperature is maintained for 4 hours. The temperature is raised to 160° and the temperature is maintained for 1 hour. The reaction temperature is increased to 170° C. and the temperature is maintained for 3 hours. A total of 48 grams of distillate is collected. The reaction mixture is cooled to 140° C. The reaction mixture was vacuum stripped to 35 mm Hg at 170° C. Sulfur (20.7 grams, 0.65 equivalents) is added portionwise at 140–145 ° C. to the reaction vessel and the temperature maintained for 2 hours. The reaction mixture is cooled and the product contains 4.5% phosphorus and 4.9% sulfur.

EXAMPLE 8

A reaction vessel is charged with 300 grams (2.54 moles) of 2-butoxyethanol and 215 grams (1.3 equivalents) of triethylphosphite. The reaction mixture is heated to 135–140° C. and the temperature is maintained for 8 hours. The temperature is raised to 180° C. at a rate of 100 every hour. The reaction temperature is maintained at 2 hours and a total of 75 grams of distillate is collected. The reaction mixture is cooled to 170° C. and vacuum stripped at 200 mm Hg over 3 hours. The residue is cooled to room temperature.

The 375 grams (1.2 equivalents) of the above phosphite is added to a reaction vessel and heated to 140–145° C. Sulfur (36.5 grams, 1.1 equivalents) is added portionwise over 2 hours. The reaction temperature is maintained for 2 hours at 145° C. The product is cooled and decanted. The product contains 8.9% phosphorus and 9.6% sulfur.

EXAMPLE 9

A reaction vessel is charged with 811 grams (2.4 moles) of the polyethoxylated alcohol of Example 1, 337 grams (2.44 moles) of diethyl phosphite, and 3.0 grams of methylsulfonic acid (70%). The reaction mixture is heated to 145–150° C. under a nitrogen flow of 0.1 SCFH. The temperature is maintained for 5 hours while 56 grams of distillate are collected. The reaction mixture is vacuum stripped to 40 mm Hg at 150° C. while 80 grams of distillate are collected. The residue is cooled to 60° C. where 3.0 grams of sodium bicarbonate are added. The reaction mixture is filtered through diatomaceous earth at 40–50° C. and the filtrate is the desired product. The product has 7.8% phosphorus.

A reaction vessel is charged with the above phosphite (350 grams, 0.83 equivalents) and of a mixture of $C_{11-14}$ tertiary aliphatic primary amines (158 grams, 0.83 equivalents) available commercially as Primene 81R from Rohm & Haas Chemical Company. The mixture is heated to 120° C. where 22 grams (0.6 equivalents) of sulfur is added portionwise while maintaining the temperature at 120–125° C. The reaction temperature is maintained at 120–125° C. for 1 hour. The reaction temperature is increased to 150° C. and the temperature is maintained for 2 hours. The reaction mixture is cooled to room temperature and filtered through diatomaceous earth. The filtrate is the desired product and has 4.9% phosphorus and 4.0% sulfur.

EXAMPLE 10

The phosphite of Example 7 (257 grams, 0.61 moles) and 2-ethylhexylamine (69 grams, 0.52 moles) is added to a reaction vessel and heated to 85° C. Sulfur (16.6 grams, 0.52 equivalents) is added in portions over 90 minutes while maintaining the reaction temperature at 85–90° C. The reaction temperature is maintained for 2 hours at 90° C. The resulting product contains 5.1% phosphorus, and 5.2% sulfur.

EXAMPLE 11

(a) A reaction vessel is charged with (700 grams, 2.1 moles) of the polyethoxylated alcohol of Example 1, (116 grams, 0.7 moles) of triethylphosphite and 0.5 grams of a 98% solution of sulfuric acid. The reaction mixture is heated to 140° C. and the temperature is maintained for 2 hours at 140–150° C. while 30 grams of distillate are collected. The temperature is raised to 190° C. over the next two hours and the temperature is maintained at 190° C. for two hours while 35 grams of distillate is collected. The reaction mixture is blown with nitrogen at 0.2 standard cubic feet per hour at 190° C. for 8 hours, while an additional 13 grams of distillate is collected. The reaction mixture is stripped to 190° C. and 200 mm Hg for 1 hour and then the pressure is reduced to 30 mm Hg. The residue is cooled and pressurized with nitrogen at 50° C. Sodium carbonate (one gram) is added to the residue and the mixture is stirred for 15 minutes. The mixture is filtered through diatomaceous earth. The filtrate is the desired product which has 2.7% phosphorus.

(b) The above product (550 grams, 0.5 moles) is added to a reaction vessel and heated to 140° C. Sulfur (13.9 grams, 0.4 moles) is added portionwise over 1 hour while maintaining the temperature at 140–145° C. The temperature is maintained for an additional hour at 145° C. The mixture is cooled to room temperature and decanted. The desired product contains 3.1% phosphorus and 3.1% sulfur.

The thiophosphorus acid esters or their salts may be used in combination with at least one sulfur compound and/or at least phosphorus or boron antiwear or extreme pressure agent. The sulfur containing antiwear or extreme pressure agent is present in an amount sufficient to improve the antiwear or extreme pressure properties of the lubricant, functional fluid or grease. Typically, the amount of sulfur compound is from about 0.05% to about 10% by weight, or preferably, from about 0.1% up to about 8%, or more preferably from about 0.3% up to about 7%, more preferably from about 0.5% to about 5% by weight.

Sulfur Containing Antiwear/Extreme Pressure Agent

The sulfur containing antiwear and/or extreme pressure agents include sulfur compounds, dithiocarbamate compounds, or mixtures thereof. The sulfur compounds include mono- or polysulfide compositions, or mixtures thereof. The sulfur compounds are generally characterized as having sulfide linkages containing an average from 1 up to about 10, or from about 2 up to about 8, or from about 3 up to about 4 sulfur atoms. In one embodiment, the organic polysulfides may be a mixture of di-, tri- or tetrasulfide materials.

In one embodiment, the sulfur containing antiwear or extreme pressure agent is a sulfurized compound. The sulfurized compounds may be prepared using one or more of the sulfur sources from above, preferably either elemental sulfur or the combination of sulfur and hydrogen sulfide are used. In one embodiment, from about 25% up to about 80%, or from about 30% up to about 75%, or from about 45% up to about 65% by weight of the sulfur is from hydrogen sulfide.

Materials which may be sulfurized include oils, unsaturated fatty acids, unsaturated fatty esters, olefins, terpenes, or Diels-Alder adducts. Oils which may be sulfurized are natural or synthetic oils, including mineral oils, lard oil, carboxylic acid esters derived from aliphatic alcohols and fatty acids or aliphatic carboxylic acids (e.g., myristyl oleate and oleyl oleate), and synthetic sperm whale oil substitutes and synthetic unsaturated esters or glycerides.

The unsaturated fatty acids generally contain from about 8 to about 30, or from about 12 to about 24 carbon atoms. Examples of unsaturated fatty acids include palmitoleic acid, oleic, linoleic, linolenic, erucic acid, lard oil acid, soybean oil acid, tall oil and rosin acid.

The unsaturated fatty esters include fatty oils, that is, naturally occurring or synthetic esters of glycerol and one or more of the above unsaturated fatty acids. Examples of fatty esters include animal fats, such as Neat's-foot oil, lard oil, depot fat, beef tallow, vegetable oils including cottonseed oil, corn oil, safflower oil, sesame oil, soybean oil, and sunflower seed oil. The unsaturated fatty esters also may be prepared by esterifying alcohols and polyols with an unsaturated fatty acid. The alcohols, such as those described herein and including mono- and polyhydric alcohols, such as methanol, ethanol, propanol, butanol, ethylene glycol, neopentyl glycol, and glycerol.

The olefins, which may be sulfurized, contain at least one olefinic double bond, which is defined as a non-aromatic double bond. The olefins include the dienes described below. In its broadest sense, the olefin may be defined by the formula $R^*_1R^*_2C{=}CR^*_3R^*_4$, wherein each of $R^*_1$, $R^*_2$, $R^*_3$, and $R^*_4$ is hydrogen, or an organic group. In general, the R* groups in the above formula which are not hydrogen may be represented by $—(CH_2)_n—A$, wherein n is a number from 0 to about 10 and A is represented by $—C(R^*_5)_3$, $—COOR^*_5$, $—CON(R^*_5)_2$, $—COON(R^*_5)_4$, —COOM, —CN, —X, $—YR^*_5$ or —Ar, wherein: each $R^*_5$ is independently hydrogen, or a hydrocarbyl group, with the proviso that any two $R^*_5$ groups may be connected to form a ring of up to about 12 carbon atoms; M is one equivalent of a metal cation (preferably Group I or II, e.g., sodium, potassium, barium, or calcium) or an ammonium cation; X is halogen (e.g., chloro, bromo, or iodo); Y is oxygen or divalent sulfur; Ar is an aromatic group of up to about 12 carbon atoms.

The olefinic compound is usually one in which each R group which is not hydrogen is independently alkyl, alkenyl or aryl group. In one embodiment, $R^*_3$ and $R^*_4$ are hydrogen and $R^*_1$ and $R^*_2$ are alkyl or aryl, especially alkyl having from 1 up to about 30, or up to about 16, or up to about 8, or even up to about 4 carbon atoms. Olefins having from 2 up to about 30, or from about 3 up to about 16 (most often less than about 9) carbon atoms are particularly useful. Olefins having from 2 up to about 5, or from 2 up to about 4 carbon atoms are particularly useful. Isobutene, propylene and their dimers, trimers and tetramers, and mixtures thereof are especially preferred olefins. Of these compounds, isobutylene and diisobutylene are particularly desirable.

In another embodiment, the organic polysulfide comprise sulfurized olefins prepared by the sulfochlorination of olefins containing four or more carbon atoms and further treatment with inorganic higher polysulfides according to U.S. Pat. No. 2,708,199.

In one embodiment, the sulfurized olefins may be produced by (1) reacting sulfur monochloride with a stoichiometric excess of a lower olefin, e.g. containing two to about seven carbon atoms, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to about 5 carbon atoms and examples include ethylene, propylene, butylene, isobutylene, amylene, etc.

The sulfurized olefin may also be prepared by reacting, under superatmospheric pressure, the olefin with a mixture of sulfur and hydrogen sulfide in the presence, or absence, of a catalyst, followed by removal of low boiling materials. The olefins which may be sulfurized, the sulfurized olefin, and methods of preparing the same are described in U.S. Pat. Nos. 4,119,549, 4,199,550, 4,191,659, and 4,344,854. The disclosure of these patents is hereby incorporated by reference for its description of the sulfurized olefins and preparation of the same.

In one embodiment, the organic polysulfide is a mixture comprising at least about 75%, or at least about 80%, or at least about 85%, or at least about 90% dihydrocarbyl trisulfide. The organic polysulfide generally contains from about 0.1%, or from about 0.5% up to about 8% dihydrocarbyl disulfide, and less than about 5% dihydrocarbyl higher polysulfides. Higher polysulfides are defined as containing four or more sulfide linkages. In one embodiment, the amount of trisulfide is at least about 92%, or preferably at least about 93%. In another embodiment, the amount of dihydrocarbyl higher polysulfides is less than 4%, or preferably less than about 3%. In one embodiment, the dihydrocarbyl disulfide is present in an amount from about 0.1%, or from about 0.5% up to about 5%, or preferably from about 0.6% up to about 3%.

The sulfide analysis is performed on a Varian 6000 Gas Chromatograph and FID detector SP-4100 computing integrator. The Column is a 25 m. Megabore SGE BP-1. The temperature profile is 75° C., hold 2 min., to 250° C. at 6° C./min. The helium flow is 6.0 ml/min plus make-up. The injection temperature is 200° C. and the detector temperature is 260° C. The injection size is 0.6, ul. References are the monosulfide, disulfide and trisulfide analogues to the sulfur composition for analysis. The references may be obtained by fractionating the product to form sulfide fractions (S1, S2 and S3) to be used for analysis. The procedure for analysis is as follows. (1) An area % determination is run on each of the reference samples to determine its purity. (2) An area % determination is run on the sample to be tested to get a general idea of its composition. (3) A calibration blend is accurately weighed based on the area % results of the sample to be tested: then the internal standard toluene, is added to the blend in an amount equal to approximately one-half of the weight of the largest component. (This should give an area approximately the same as that of the largest component.) (4) The weights of each component (i.e., S-1, S-2 and S-3) are corrected by the % purity from step 1. (5) The calibration blend is run in triplicate using the corrected weights and then calculated, using the following formula, to reflect the multiple peaks in S-1 and S-2:

$$RF = \frac{(\text{concentration of components}^{*})}{(\text{total area of peaks})} \frac{(\text{area of internal standard})}{(\text{concentration of internal standard})}$$

*Adjusted for purity of the standard i.e.: component weight times percent purity equals concentration of component.

(6) These response factors, plus the response factor for the single S-3 peak are used for determining weight percent results for the samples to be tested.

(7) Results for S-1 and S-2 are adjusted to include all the peaks attributed to them. (8) Higher polysulfides are determined by difference using the following formula:

S-4=100%−(S-1+S-2+S-3+light ends)

Light ends are defined as any peaks eluded prior to the internal standard.

The conditions of fractional distillation are determined by the sulfur composition being distilled. Fractional distillation involves heating the sulfur composition to a temperature at which boiling occurs. The distillation system is brought to equilibrium and the distillation commences with a chosen reflux ratio. The term reflux ratio refers to the ratio of the amount of material returned to the distillation apparatus to the amount of material removed from the distillation. For instance, a reflux ratio of 5:1 means that five parts of distillate are returned to the distillation apparatus for every one part removed from the apparatus. The fractions obtained from the distillation are removed from the distillation apparatus. The amount of the desired fraction may be calculated by determining the proportion of sulfides. The desired fraction is obtained by maintaining accurate temperature control on the distillation system. The boiling fractions are removed at a specific vapor and temperature for that fraction. The reflux ratio is adjusted to maintain the temperature at which this fraction boils. After removal of the desired fraction, the fraction may be further filtered as desired.

In general, fractionation is carried out in a continuous or a batch process. In a continuous process the material to be fractionated is fed to a fractionating column. Parameters are controlled in the system such as feed flow, temperatures throughout the column, and the reflux ratio, etc., to separate the components in the feed into an overhead and bottoms stream. These parameters are adjusted to maintain the desired composition in the overhead and bottoms streams.

For a batch process, the material to be fractionated is charged to vessel under agitation and is heated to boiling temperatures. Once the material reaches the boiling point, the fractionation column system is brought to equilibrium. Subsequently, the desired reflux ratio is set. Collection of the distillate is commenced, as described herein. The reflux ratio is increased as is necessary to maintain the appropriate temperatures in the fractionating column system. As the distillation rate slows, the reflux ratio is increased until eventually the collection of the distillate stops. The different fractions are separated as the above process is repeated at higher temperatures.

The following examples relate to sulfurized olefins.

EXAMPLE S-1

Sulfur (526 parts, 16.4 moles) is charged to a jacketed, high-pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 920 parts (16.4 moles) of isobutene and 279 parts (8.2 moles) of hydrogen sulfide are charged to the reactor. The reactor is heated using steam in the external jacket, to a temperature of about 182° C. over about 1.5 hours. A maximum pressure of 1350 psig is reached at about 168° C. during this heat-up. Prior to reaching the peak reaction temperature, the pressure starts to decrease and continues to decrease steadily as the gaseous reactants are consumed. After about 10 hours at a reaction temperature of about 182° C., the pressure is 310–340 psig and the rate of pressure change is about 5–10 psig per hour. The unreacted hydrogen sulfide and isobutene are vented to a recovery system. After the pressure in the reactor has decreased to atmospheric, the sulfurized mixture is recovered as a liquid. The mixture is blown with nitrogen at about 100° C. to remove low boiling materials including unreacted isobutene, mercaptans and monosulfides. The residue after nitrogen blowing is agitated with 5% Super Filtrol and filtered, using a diatomaceous earth filter aid. The filtrate is the desired sulfurized composition which contains 42.5% sulfur.

EXAMPLE S-2

Sulfur monochloride (2025 grams, 15.0 moles) is heated to 45° C. Through a sub-surface gas sparge, 1468 grams (26.2 moles) of isobutylene gas are fed into the reactor over a 5-hour period. The temperature is maintained between 45–50° C. At the end of the sparging, the reaction mixture increases in weight of 1352 grams. In a separate reaction vessel are added 2150 grams (16.5 moles) of 60% flake sodium sulfide, 240 grams (7.5 moles) sulfur, and a solution of 420 ml. of isopropanol in 4000 ml. of water. The contents are heated to 40° C. The adduct of the sulfur monochloride and isobutylene previously prepared is added over a three-quarter hour period while permitting the temperature to rise to 75° C. The reaction mixture is heated to reflux for 6 hours, and afterward the mixture is permitted to form into separate layers. The lower aqueous layer is discarded. The upper organic layer is mixed with two liters of 10% aqueous sodium hydroxide, and the mixture is heated to reflux for 6 hours. The organic layer is again removed and washed with one liter of water. The washed product is dried by heating at 90° C. and 30 mm Hg pressure for 30 minutes. The residue is filtered through diatomaceous earth filter aid to give 2070 grams of a clear yellow-orange liquid.

EXAMPLE S-3

The product of Example S-1 (1000 lbs) is charged to a reactor, under medium agitation, and is heated to approximately 88° C.–94° C. The product is brought to equilibrium and equilibrium is maintained for 30 minutes prior to collection of distillate. The reflux ratio is set at 4:1, and the temperature is raised to 105° C. Distillate is collected for approximately 20–24 hours and the yield approximates 230–260 lbs. The temperature is raised to 105° C.–107° C., and the system is brought to equilibrium. The temperature is maintained for 30 minutes prior to collection of distillate. The reflux ratio is set at 4:1, and the temperature is raised to 121° C.–124° C., in order to ensure a steady distillation rate. The distillate is collected over 75–100 hours, and is approximately 300–400 lbs of the desired product. The desired product contains 2.7% S2, 93.15% S3, and 4.04% higher polysulfides.

EXAMPLE S-4

In a vessel with a fractionation column, 10,000 grams of the product of Example S-1 is brought to a boil, at approximately 200° F., under medium agitation. The column is brought to equilibrium by regulating the vapor temperature and equillibrium is maintained for 30 minutes prior to collection of distillate. The reflux ratio is set at 5:1 and disillate is collected until the accumulation of distillate is less than 5 ml in 15 minutes. A portion of distillate (100ml) is collected and contains 88 grams of distillate at a vapor temperature of 56° C. The temperature of the vessel is raised 15° C., and an aliqot of 50 grams is removed in 65 ml of distillate, at a vapor temperature of 58° C. Distillate (2000 ml) is collected and 1838 grams of distillate is removed. Collection is continued as long as the distillate rate stays greater than 5 ml/15 minutes. If boiling drops off, the temperature of the vessel is raised 5.5° C. and distillate collection is continued until the distillation rate is less than 5 ml/15 minutes. The distillate contains approximately 473 grams of desired product. For the final collection of distillate, the temperature is raised 9° C. to 116° C., not exceeding 121° C., and 220 ml of the distillate is removed which contains 214 grams of distillate at a vapor temperature of 69° C. Collection of the remainder of the distillate, containing approximately 4114 grams of the desired product, is continued until the distillation rate is less than 5 ml/15 minutes. A yield after fractionation should approximate 6777 grams of the desired product. The desired product contains approximately 2% S2, 96.6% S3, and 1.3% higher polysulfides.

In another embodiment, the sulfur compound is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Pine-oil derivatives, which are commercially available from Hercules Incorporated, include alpha-terpineol (a high purity tertiary terpene alcohol); and Terpineol 318 Prime (a mixture containing about 60–65% weight alpha-terpineol and 15–20% weight beta-terpineol); Yarmor 302; Herco pine oil; Yarmor 302W; Yarmor F; and Yarmor 60.

In another embodiment, the sulfur compound is a sulfurized Diels-Alder adduct. The sulfurized Diels-Alder adduct is prepared by reacting one or more Diels-Alder adducts with one or more of the above sulfur sources, such as elemental sulfur. A Diels-Alder reaction involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts. Other dienes include linear 1,3-conjugated dienes, cyclic dienes, such as cyclopentadienes, fulvenes, 1,3-cyclohexadienes, 1,3,5-cycloheptatrienes, cyclooctatetraene, etc.

Dienophiles, used in preparing the Diels-Alder adducts, include nitroalkenes; alpha, beta-ethylenically unsaturated carboxylic esters, acids or amides; ethylenically unsaturated aldehydes and vinyl ketones. The unsaturated carboxylic esters, acids and amides are described below. Specific examples of dienophiles include 1-nitrobutene-1-alkylacrylates, acrylamide, N,N'-dibutylacrylamide, methacrylamide, crotonaldehyde; crotonic acid, dimethyldivinyl ketone, methylvinyl ketone, propiolaldehyde, methylethynyl ketone, propiolic acid, propargylaldehyde, cyclopentenedione, 3-cyanocoumaran, etc. The sulfurized Diels-Alder adducts are readily prepared by heating a mixture of a sulfur source, preferably elemental sulfur and at least one of the Diels-Alder adducts of the types discussed herein above at a temperature within the range of from about 110° C. to just below the decomposition temperature of the Diels-Alder adducts. Temperatures within the range of about 110° to about 200° C. will normally be used. Generally, the molar ratio of sulfur source to Diels-Alder adduct is in a range of from about 0.75 up to about 4, or from about 1 up to about 3, or up to about 2.5. The Diels-Alder adducts are a well-known, art-recognized class of compounds prepared from dienes by a Diels-Alder reaction. An example of a useful sulfurized Diels-Alder adduct is a sulfurized Diels-Alder adduct of butadiene and butyl-acrylate. Sulfurized Diels-Alder adducts are described in U.S. Pat. Nos. 3,498,915, 4,582,618, and Re 27,331. These patents are hereby incorporated by reference for their disclosures of sulfurized Diels-Alder adducts and methods of making the same.

Phosphorus-Containing Antiwear or Extreme Pressure Agents

The phosphorus containing antiwear or extreme pressure agent is typically present in an amount up to about 20% by weight, preferably up to about 10% by weight of the lubricant or functional fluid. Typically, the phosphorus containing antiwear/extreme pressure agent is present in the lubricants and functional-fluids at a level from about 0.01% up to about 10%, or from about 0.05% or up to about 4%, or from about 0.08% up to about 3% or from 0.1% to about 2% by weight.

The phosphorus-containing antiwear or extreme pressure agent can be a phosphorus acid ester or salt thereof, a phosphite, or a phosphorus-containing carboxylic acid, ester, ether or amide. The phosphorus acids include phosphoric acids, phosphonic acids, phosphinic acids, and thiophosphoric acids, including dithiophosphoric acid as well as the monothiophosphoric acid, thiophosphinic acids, and thiophosphonic acids.

In one embodiment, the phosphorus containing antiwear or extreme pressure agents is a phosphorus acid ester. The ester is prepared by reacting one or more phosphorus acids or anhydrides with an alcohol containing from one to about 30, or from two to about 24, or from about 3 to about 12 carbon atoms. The alcohols used to prepare the phosphorus acid esters include those described above. The phosphorus acid or anhydride is generally an inorganic phosphorus reagent, such as phosphorus pentoxide, phosphorus trioxide, phosphorus tetroxide, phosphorous acid, phosphoric acid, phosphorus halide, $C_{1-7}$ phosphorus esters, or a phosphorus sulfide which includes phosphorus pentasulfide, phosphorus sesquisulfide, phosphorus heptasulfide and the like. In one embodiment, the phosphorus acid is a thiophosphorus acid or salt thereof. The thiophosphoric acids and their salts are described above. Examples of phosphorus acid esters include phosphoric acid di- and tri-esters prepared by reacting a phosphoric acid or anhydride with cresol alcohols, e.g. tricresylphosphate.

In one embodiment, the phosphorus containing antiwear or extreme pressure agent is a phosphorus ester prepared by reacting one or more dithiophosphoric acid with an epoxide or a glycol. This reaction product may be used alone, or further reacted with a phosphorus acid, anhydride, or lower ester. The epoxide is generally an aliphatic epoxide or a styrene oxide. Examples of useful epoxides include ethylene oxide, propylene oxide, butene oxide, octene oxide, dodecene oxide, styrene oxide, etc. Propylene oxide is preferred. The glycols may be aliphatic glycols, having from 1 to about 12, or from about 2 to about 6, or from about 2 to about 3 carbon atoms, or aromatic glycols. Glycols include ethylene glycol, propylene glycol, catechol, resorcinol, and the like. The dithiophosphoric acids, glycols, epoxides, inorganic phosphorus reagents and methods of reacting the same are described in U.S. Pat. No. 3,197,405 and U.S. Pat. No. 3,544,465 which are incorporated herein by reference for their disclosure to these.

The following Examples P-1 and P-2 exemplify the preparation of useful phosphorus acid esters.

EXAMPLE P-1

Phosphorus pentoxide (64 grams) is added at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture is heated at 75° C. for 2.5 hours, mixed with a diatomaceous earth and filtered at 70° C. The filtrate contains 11.8% by weight phosphorus, 15.2% by weight sulfur, and has an acid number of 87 (bromophenol blue).

EXAMPLE P-2

A mixture of 667 grams of phosphorus pentoxide and the reaction product of 3514 grams of diisopropyl phosphorodithioic acid with 986 grams of propylene oxide at 50° C. is heated at 85° C. for 3 hours and filtered. The filtrate contains 15.3% by weight phosphorus, 19.6% by weight sulfur, and has an acid number of 126 (bromophenol blue).

The following Examples P-3 to P-6 exemplify the preparation of useful phosphorus acid ester salts.

EXAMPLE P-3

A reaction vessel is charged with 217 grams of the filtrate from Example P-1. A commercial aliphatic primary amine (66 grams), having an average molecular weight of 191 in which the aliphatic radical is a mixture of tertiary alkyl radicals containing from 11 to 14 carbon atoms, is added over a period of 20 minutes at 25–60° C. The resulting product has a phosphorus content of 10.2% by weight, a nitrogen content of 1.5% by weight, and an acid number of 26.3.

EXAMPLE P-4

The filtrate of Example P-2 (1752 grams) is mixed at 25–82° C. with 764 grams of the aliphatic primary amine used in of Example P-3. The resulting product has 9.95% phosphorus, 2.72% nitrogen, and 12.6% sulfur.

EXAMPLE P-5

Phosphorus pentoxide (852 grams) is added to 2340 grams of iso-octyl alcohol over a period of 3 hours. The temperature increases from room temperature but is maintained below 65° C. After the addition is complete the reaction mixture is heated to 90° C. and the temperature is maintained for 3 hours. Diatomaceous earth is added to the mixture, and the mixture is filtered. The filtrate has 12.4% phosphorus, a 192 acid neutralization number (bromophenol blue) and a 290 acid neutralization number (phenolphthalein).

The above filtrate is mixed with 200 grams of toluene, 130 grams of mineral oil, 1 gram of acetic acid, 10 grams of water and 45 grams of zinc oxide. The mixture is heated to 60–70° C. under a pressure of 30 mm Hg. The resulting product mixture is filtered using a diatomaceous earth. The filtrate has 8.58% zinc and 7.03% phosphorus.

EXAMPLE P-6

Phosphorus pentoxide (208 grams) is added to the product prepared by reacting 280 grams of propylene oxide with 1184 grams of O,O'-diisobutylphosphorodithioic acid at 30–60° C. The addition is made at a temperature of 50–60° C. and the resulting mixture is then heated to 80° C. and held at that temperature for 2 hours. The commercial aliphatic primary amine identified in Example P-3 (384 grams) is added to the mixture, while the temperature is maintained in the range of 30–60° C. The reaction mixture is filtered through diatomaceous earth. The filtrate has 9.31% phosphorus, 11.37% sulfur, 2.50% nitrogen, and a base number of 6.9 (bromophenol blue indicator).

In another embodiment, phosphorus antiwear or extreme pressure agent (C) is a metal salt of (a) at least one dithiophosphoric acid and (b) at least one aliphatic or alicyclic carboxylic acid. The dithiophosphoric acids are described above. The carboxylic acid may be a monocarboxylic or polycarboxylic acid, usually containing from 1 to about 3, or just one carboxylic acid group. The preferred carboxylic acids are those having the formula RCOOH, wherein R is a hydrocarbyl group, preferably free from acetylenic unsaturation. Generally, R contains from about 2 up to about 40, or from about 3 up to about 24, or from about 4 up to about 12 carbon atoms. In one embodiment, R contains from about 4 up to about 12, or from about 6 up to about 8 carbon atoms. In one embodiment, R is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids, and linoteic dimer acid. A preferred carboxylic acid is 2-ethylhexanoic acid.

The metal salts may be prepared by merely blending a metal salt of a dithiophosphoric acid with a metal salt of a carboxylic acid in the desired ratio. The ratio of equivalents of dithiophosphoric acid to carboxylic acid is from about 0.5 up to about 400 to 1. The ratio may be from about 0.5 up to about 200, or up to about 100, or up to about 50, or up to about 20 to 1. In one embodiment, the ratio is from 0.5 up to about 4.5 to 1, or from about 2.5 up to about 4.25 to 1. For this purpose, the equivalent weight of a dithiophosphoric acid is its molecular weight divided by the number of —PSSH groups therein, and the equivalent weight of a carboxylic acid is its molecular weight divided by the number of carboxy groups therein.

In another embodiment, the phosphorus acid is a dithiophosphoric acid or phosphorodithioic acid. The dithiophosphoric acid may be represented by the formula $(R_10)_2PSSH$, wherein each $R_1$ is independently a hydrocarbyl group, containing from about 3 to about 30, or from about 3 up to about 18, or from about 4 up to about 12, or up to about 8 carbon atoms. Examples $R_1$ include isopropyl, isobutyl, n-butyl, sec-butyl, amyl, n-hexyl, heptyl, 2-ethylhexyl, isooctyl, nonyl, behenyl, decyl, dodecyl, tridecyl, alkylphenyl groups, or mixtures thereof. Illustrative lower alkylphenyl $R_1$ groups include butylphenyl, amylphenyl, and heptylphenyl and mixtures thereof. Examples of mixtures of $R_1$ groups include: 1-butyl and 1-octyl; 1-pentyl and 2-ethyl-1-hexyl; isobutyl and n-hexyl; isobutyl and isoamyl; 2-propyl and 2-methyl-4-pentyl; isopropyl and sec-butyl; and isopropyl and isooctyl.

The metal thiophosphates are prepared by the reaction of a metal base with the thiophosphorus acid. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, a Group IB metal, such as copper, a Group IIB metal, such as zinc, or a Group VIIB metal, such as manganese. Preferably the metal is magnesium, calcium, copper or zinc. Examples of metal compounds which may be reacted with the phosphorus acid include zinc hydroxide, zinc oxide, copper hydroxide, copper oxide, etc.

Examples of metal dithiophosphates include zinc isopropyl, methylamyl dithiophosphate, zinc isopropyl, isooctyl dithiophosphate, barium di(nonyl) dithiophosphate, zinc di(cyclohexyl) dithiophosphate, copper di(isobutyl) dithiophosphate, calcium di(hexyl) dithiophosphate, zinc isobutyl, isoamyl dithiophosphate, and zinc isopropyl, secondary-butyl dithiophosphate.

A second and preferred method for preparing the metal salts useful in this invention is to prepare a mixture of the acids in the desired ratio, such as those described above for the metal salts of the individual metal salts, and to react the acid mixture with one of the above described metal compounds. When this method of preparation is used, it is frequently possible to prepare a salt containing an excess of metal with respect to the number of equivalents of acid present; thus the metal salts may contain as many as 2 equivalents and especially up to about 1.5 equivalents of metal per equivalent of acid may be prepared. The equivalent of a metal for this purpose is its atomic weight divided by its valence. The temperature at which the metal salts are prepared is generally between about 30° C. and about 150° C., preferably up to about 125° C. U.S. Pat. Nos. 4,308,154 and 4,417,990 describe procedures for preparing these metal salts and disclose a number of examples of such metal salts. These patents are hereby incorporated by reference for those disclosures.

The phosphorus-containing antiwear or extreme pressure agent may also be a phosphite. In one embodiment, the phosphite is a di- or trihydrocarbyl phosphite. Preferably each hydrocarbyl group has from 1 to about 24 carbon atoms, more preferably from 1 to about 18 carbon atoms, and more preferably from about 2 to about 8 carbon atoms. Each hydrocarbyl group may be independently alkyl, alkenyl, or aryl. When the hydrocarbyl group is an aryl group, then it contains at least about 6, preferably from about 6 to about 18 carbon atoms. Examples of the alkyl or alkenyl groups include propyl, butyl, hexyl, heptyl, octyl, oleyl, linoleyl, stearyl, etc. Examples of aryl groups include phenyl, naphthyl, heptylphenol, etc. Preferably each hydrocarbyl group is independently propyl, butyl, pentyl, hexyl, heptyl, oleyl or phenyl, more preferably butyl, oleyl or phenyl and more preferably butyl or oleyl. Phosphites and their preparation are known and many phosphites are available commercially. Particularly useful phosphites are dibutylhydrogen phosphite, trioleyl phosphite and triphenyl phosphite.

In one embodiment, the phosphorus-containing antiwear or extreme pressure agent may be a phosphorus-containing amide. The phosphorus-containing amides may be prepared by the reaction of a phosphorus acid, preferably a dithiophosphcric acid, as described above, with an unsaturated amide. Examples of unsaturated amides include acrylamide, N,N'-methylene bisacrylamide, methacrylamide, crotonamide, and the like. The reaction product of the phosphorus acid with the unsaturated amide may be further reacted with linking or coupling compounds, such as formaldehyde or paraformaldehyde, to form coupled compounds. The phosphorus-containing amides are known in the art and are disclosed in U.S. Pat. Nos. 4,876,374, 4,770,807 and 4,670,169 which are incorporated by reference for their disclosures of phosphorus amides and their preparation.

In one embodiment, the phosphorus-containing antiwear or extreme pressure agent is a phosphorus-containing carboxylic ester. The phosphorus-containing carboxylic esters may be prepared by reaction of one of the above-described phosphorus acids, such as a dithiophosphoric acid, and an unsaturated carboxylic acid or ester, such as a vinyl or allyl acid or ester. If the carboxylic acid is used, the ester may then be formed by subsequent reaction with an alcohol. In one embodiment, the unsaturated carboxylic acids include the unsaturated fatty acids and esters described above.

The vinyl ester of a carboxylic acid may be represented by the formula $RCH{=}CH{-}O(O)CR_1$, wherein R is a hydrogen or hydrocarbyl group having from 1 to about 30 carbon atoms, preferably hydrogen or a hydrocarbyl group having from 1 to about 12, more preferably hydrogen, and $R_1$ is a hydrocarbyl group having from 1 to about 30 carbon atoms, preferably from 1 to about 12, more preferably from 1 to about 8. Examples of vinyl esters include vinyl acetate, vinyl 2-ethylhexanoate, vinyl butanoate, and vinyl crotonate.

In one embodiment, the unsaturated carboxylic ester is an ester of an unsaturated carboxylic acid, such as maleic, fumaric, acrylic, methacrylic, itaconic, citraconic acids and the like. The ester can be represented by the formula $RO{-}(O)C{-}HC{=}CH{-}C(O)OR$, wherein each R is independently a hydrocarbyl group having from 1 to about 18 carbon atoms, preferably from 1 to about 12, more preferably from 1 to about 8 carbon atoms, Examples of unsaturated carboxylic esters, useful in the present invention, include methylacrylate, ethylacrylate, 2-ethylhexylacrylate, 2-hydroxyethylacrylate, ethylmethacrylate, 2-hydroxyethylmethacrylate, 2-hydroxypropylmethacrylate, 2-hydroxypropylacrylate, ethylmaleate, butylmaleate and 2-ethylhexylmaleate. The above list includes mono- as well as diesters of maleic, fumaric and citraconic acids.

In one embodiment, the phosphorus-containing antiwear agent is the reaction product of a phosphorus acid and a vinyl ether. The vinyl ether is represented by the formula $R—CH_2=CH—OR_1$, wherein R is hydrogen or a hydrocarbyl group having from 1 to about 30, preferably from 1 to about 24, more preferably from 1 to about 12 carbon atoms, and $R_1$ is a hydrocarbyl group having from 1 to about 30 carbon atoms, preferably from 1 to about 24, more preferably from 1 to about 12 carbon atoms. Examples of vinyl ethers include vinyl methylether, vinyl propylether, vinyl 2-ethylhexylether and the like.

In another embodiment, the phosphorus containing antiwear or extreme pressure agent is a metal thiophosphate, such as metal dithiophosphates. The metal thiophosphate are prepared by reacting a metal base with one or more thiophosphorus acids. The thiophosphorus acid may be prepared by reacting one or more phosphorus sulfides, which include phosphorus pentasulfide, phosphorus sesquisulfide, phosphorus heptasulfide and the like, with one or more alcohols. The ihiophosphorus acids may be mono- or dithiophosphorus acids. The alcohols generally contain from one to about 30, or from two to about 24, or from about 3 to about 12, or up to about 8 carbon atoms. Alcohols used to prepare the thiophosphoric acids include butyl, amyl, 2-ethylhexyl, hexyl, octyl, oleyl, and cresol alcohols. Examples of commercially available alcohols include Alfol 810 (a mixture of primarily straight chain, primary alcohols having from 8 to 10 carbon atoms); Alfol 1218 (a mixture of synthetic, primary, straight-chain alcohols containing 12 to 18 carbon atoms); Alfol 20+ alcohols (mixtures of C18–C28 primary alcohols having mostly C20 alcohols as determined by GLC (gas-liquid-chromatography); and Alfol 22+ alcohols (C18–C28 primary alcohols containing primarily C22 alcohols). Alfol alcohols are available from Vista Chemical Company. Another example of a commercially available alcohol mixtures are Adol 60 (about 75% by weight of a straight chain C22 primary alcohol, about 15% of a C20 primary alcohol and about 8% of C18 and C24 alcohols) and Adol 320 (oleyl alcohol). The Adol alcohols are marketed by Ashland Chemical.

A variety of mixtures of monohydric fatty alcohols derived from naturally occurring triglycerides and ranging in chain length of from $C_8$ to $C_{18}$ are available from Procter & Gamble Company. These mixtures contain various amounts of fatty alcohols containing mainly 12, 14, 16, or 18 carbon atoms. For example, CO-1214 is a fatty alcohol mixture containing 0.5% of $C_{10}$ alcohol, 66.0% of $C_{12}$ alcohol, 26.0% of $C_{14}$ alcohol and 6.5% of $C_{16}$ alcohol.

Another group of commercially available mixtures include the "Neodol" products available from Shell Chemical Co. For example, Neodol 23 is a mixture of $C_{12}$ and $C_{13}$ alcohols; Neodol 25 is a mixture of $C_2$ and $C_{15}$ alcohols; and Neodol 45 is a mixture of $C_{14}$ to $C_{15}$ linear alcohols. Neodol 91 is a mixture of $C_9$, $C_{10}$ and $C_{11}$ alcohols.

Fatty vicinal diols also are useful and these include those available from Ashland Oil under the general trade designation Adol 114 and Adol 158. The former is derived from a straight chain alpha-olefin fraction of $C_{11}$–$C_{14}$, and the latter is derived from a $C_{15}$–$C_{18}$ alpha-olefin fraction.

Boron-Containing Antiwear/Extreme Pressure Agents (E)

The lubricants and/or functional fluids may additionally contain a boron antiwear or extreme pressure agent. Typically, the boron containing antiwear/extreme pressure agent is present in the lubricants and functional fluids at a level from about 0.01% up to about 10%, or from about 0.05% or up to about 4%, or from about 0.08% up to about 3%, or from 0.1% to about 2% by weight. Examples of boron containing antiwear/extreme pressure agents include a borated dispersant; a borated overbased metal salt; an alkali metal or a mixed alkali metal, alkaline earth metal borate; a borated epoxide; and a borate ester.

In one embodiment, the boron antiwear or extreme pressure agent is a borated dispersant. Typically, the borated dispersants contain from about 0.1% up to about 5%, or from about 0.5% up to about 4%, or from 0.7% up to about 3% by weight boron. In one embodiment, the borated dispersant is a borated acylated amine, such as a borated succinimide dispersant. Borated dispersants are described in U.S. Pat. Nos. 3,000,916; 3,087,936; 3,254,025; 3,282,955; 3,313,727; 3,491,025; 3,533,945; 3,666,662 and 4,925,983. These references are incorporated by reference for their disclosure of borated dispersants.

The borated dispersants are prepared by reacting one or more of disperant with one or more of boron compound, such as boric acid. The dispersants are known in the art. The following are illustrative.

(1) "Carboxylic dispersants" are the reaction products of carboxylic acids (or derivatives thereof) containing at least about 34 and preferably at least about 54 carbon atoms and nitrogen containing compounds (such as amines), organic hydroxy compounds (such as phenols and alcohols), and/or basic inorganic materials. These reaction products include imide, amide, and ester reaction products of carboxylic acylating agents. The carboxylic dispersants are generally prepared by reacting one or more hydrocarbyl substituted carboxylic acylating agent with an amine, preferably one or more of the above polyalkylenepolyamines or condensed polyamines, or hydroxy containing compound, such as an alcohol. The hydrocarbyl substituted carboxylic acylating agent is typically the reaction product of an olefin, a polyalkene or a mixture thereof with one or more of the above unsaturated acids, anhydrides or lower alkyl esters, preferably maleic anhydride.

The hydrocarbyl group generally contains from about 8 to about 300, or from about 12 up to about 200, or from about 16 up to about 150, or from about 30 to about 100 carbon atoms. In one embodiment, the hydrocarbyl group contains from about 8 up to about 40, or from about 10 up to about 30, or from about 12 up to about 24 carbon atoms. The hydrocarbyl group may be derived from an olefin. The olefin typically contains from about 3 to about 40, or from about 4 to about 24 carbon atoms. These olefins are preferably alpha-olefins (sometimes referred to as mono-1-olefins or terminal olefins) or isomerized alpha-olefins. Examples of the alpha-olefins include 1-octene, 1-nonene, 1-decene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tetracosene, etc. Commercially available alpha-olefin fractions that can be used include the $C_{15-18}$ alpha-olefins, $C_{12-16}$ alpha-olefins, $C_{14-16}$ alpha-olefins, $C_{14-18}$ alpha-olefins, $C_{16-18}$ alpha-olefins, $C_{16-20}$ alpha-olefins, $C_{18-24}$ alpha-olefins, $C_{22-28}$ alpha-olefins, etc.

In another embodiment, the hydrocarbyl group is derived from a polyalkene. The polyalkene includes homopolymers and interpolymers of polymerizable olefin monomers having from 2 up to about 16, or from 2 up to about 6, or from 2 to about 4 carbon atoms. The olefins may be monoolefins, such as ethylene, propylene, 1-butene, isobutene, and 1-octene, or polyolefinic monomers, including diolefinic monomers, such 1,3-butadiene and isoprene. In one embodiment, the interpolymer is a homopolymer. In one embodiment, the homopolymer is a polybutene, such as a polybutene in which about 50% of the polymer is derived from butylene. The polyalkenes are prepared by conventional procedures. In one embodiment, the polyalkene is characterized by an $\overline{M}n$ (number average molecular weight) of at least about 400 or at least about 500. Generally, the polyalkene is characterized by having an $\overline{M}n$ from about 500 up to about 5000, or from about 700 up to about 3000, or from about 800 up to 2500, or from about 900 up to about 2000. In another embodiment, $\overline{M}n$ varies from about 500 up to about 1500, or from about 700 up to about 1300, or from about 800 up to about 1200.

The abbreviation $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC. The techniques for determining $\overline{M}n$ and $\overline{M}w$ values of polymers are well known and are described in numerous books and articles. For example, methods for the determination of $\overline{M}n$ and molecular weight distribution of polymers is described in W. W. Yan, J. J. Kirkland and D. D. Bly, "Modern Size Exclusion Liquid Chromatographs", J. Wiley & Sons, Inc., 1979.

In another embodiment, the polyalkenes have a $\overline{M}n$ from about 1300 up to about 5000, or from about 1500 up to about 4500, or from about 1700 up to about 3000. The polyalkenes also generally have a $\overline{M}w/\overline{M}n$ from about 1.5 to about 4, or from about 1.8 to about 3.6, or from about 2.5 to about 3.2. The hydrocarbyl substituted carboxylic acylating agents are described in U.S. Pat. Nos. 3,219,666 and 4,234,435, the disclosures of which is hereby incorporated by reference.

In another embodiment, the acylating agents may be prepared by reacting one or more of the above described polyalkenes with an excess of maleic anhydride to provide substituted succinic acylating agents wherein the number of succinic groups for each equivalent weight of substituent group, i.e., polyalkenyl group, is at least 1.3. The maximum number will generally not exceed 4.5. A suitable range is from about 1.3 to 3.5 and or from about 1.4 to about 2.5 succinic groups per equivalent weight of substituent groups.

Examples of these "carboxylic dispersants" are described in British Patent 1,306,529 and in many U.S. patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, 5,230,714 (Steckel) and Re 26,433.

(2) "Amine dispersants" are the reaction products of relatively high molecular weight aliphatic or alicyclic halides and amines, preferably polyalkylene polyamines. These dispersants are also described as polyalkene-substituted amines. Examples thereof are described for example, in the following U.S. Pat. Nos. 3,275,554, 3,438,757, 3,454,555, and 3,565,804.

(3) "Mannich dispersants" are the reaction products of alkylphenols, such as those discussed below and aldehydes, especially formaldehyde, and amines, especially amine condensates and polyalkylenepolyamines. The materials described in the following U.S. patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

As described above, the dispersant is reacted with a boron compound to form the borated dispersants. Boron compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. The boron esters are preferably lower alkyl (1–7 carbon atoms) esters of boric acid. Preferably, the boron compound is boric acid.

The following examples relate to borated dispersants.

EXAMPLE B-1

A mixture of 372 grams (6 atomic proportions of boron) of boric acid and 3111 grams (6 atomic proportions of nitrogen) of a acylated nitrogen composition, obtained by reacting 1 equivalent of a polybutenyl ($\overline{M}n$=850) succinic anhydride, having an acid number of 113 (corresponding to an equivalent weight of 500), with 2 equivalents of a commercial ethylene amine mixture having an average composition corresponding to that of tetraethylenepentamine, is heated at 150° C. for 3 hours and then filtered. The filtrate is found to have a boron content of 1.64% and a nitrogen content of 2.56%.

EXAMPLE B-2

(a) A reaction vessel is charged with 1000 parts of a polybutenyl ($\overline{M}n$=1000 substituted succinic anhydride having a total acid number of 108 with a mixture of 275 grams of oil and 139 parts of a commercial mixture of polyamines corresponding to 85% E-100 amine bottoms and 15% diethylenetriamine. The reaction mixture is heated to 150 to 160° C. and held for four hours. The reaction is blown with nitrogen to remove water.

(b) A reaction vessel is charged with 1405 parts of the product of Example B-4(a), 229 parts of boric acid, and 398 parts of diluent oil. The mixture is heated to 100 to 150° C. and the temperature maintained until water is removed. The final product contains 2.3% nitrogen, 1.9% boron, 33% 100 neutral mineral oil and a total base number of 60.

In another embodiment, the boron antiwear or extreme pressure agent is a borated overbased metal salt. Borated overbased metal salts are prepared by reacting one or more of the above boron compound with a overbased metal salt, such as a carbonated overbased metal salt, or by using boric acid to overbase the organic acid. Generally, the overbased metal salt is reacted with one or more of the above boron compound at about 50° C. to about 250° C., preferably from 100° C. to about 200° C. The reaction may be accomplished in the presence of a solvent, such as mineral oil, naphtha, kerosene, toluene or xylene. The borated overbased metal salts generally contains from about 0.1% up to about 15%, or from about 0.5% up to about 10%, or from about 1% up to about 8% by weight of the boron.

The overbased metal salts generally are prepared by reacting an acidic material, typically carbon dioxide, with a mixture comprising an acidic organic compound, a reaction medium comprising at least one inert, organic solvent for the acidic organic compound, a basic metal compound, and a promoter. Generally, the basic metal compounds are oxides, hydroxides, chlorides, carbonates, and phosphorus acids (phosphonic or phosphoric acid) salts, and sulfur acid (sulfuric or sulfonic) salts. The metals of the basic metal compounds are generally alkali, alkaline earth, and transition metals. Examples of the metals of the basic metal compound include sodium, potassium, lithium, magnesium, calcium, barium, titanium, manganese, cobalt, nickel, copper, zinc, and preferably sodium, potassium, calcium, and magnesium. In one embodiment, the metal salts are prepared by reacting water with a mixture comprising an acidic organic compound, a reaction medium and a promoter. These metal salts and methods of making the same are described in U.S. Pat. No. 4,627,928. This disclosure is hereby incorporated by reference.

The acidic organic compounds are selected from the group consisting of carboxylic acids and anhydrides, sulfonic acids, phosphorus acids, phenols and derivatives thereof. Preferably, the overbased compositions are prepared from carboxylic acids or sulfonic acids. The carboxylic and sulfonic acids may have substituent groups derived from one or more of olefins or polyalkenes.

Suitable carboxylic acids include aliphatic, cycloaliphatic and aromatic mono- and polybasic carboxylic acids free from acetylenic unsaturation, including naphthenic acids, alkyl- or alkenyl-substituted cyclopentanoic acids, and alkyl- or alkenyl-substituted cyclohexanoic acids, preferably alkenyl-substituted succinic acids or anhydrides. The aliphatic acids generally contain from about 8 to about 50, and preferably from about 12 to about 25 carbon atoms. The cycloaliphatic and aliphatic carboxylic acids are preferred, and they can be saturated or unsaturated. In one embodiment, the acidic organic compound is one or more carboxylic acylating agent, such as the above hydrocarbyl substituted carboxylic acylating agents.

Illustrative carboxylic acids include 2-ethylhexanoic acid, palmitic acid, stearic acid, myristic acid, oleic acid, linoleic acid, behenic acid, hexatriacontanoic acid, tetrapropylene-substituted glutaric acid, polybutenyl-substituted succinic acid derived from polybutene (n from about 200 to about 1500, preferably from about 300 to about 1500, more preferably from about 800 to about 1200), polypropylenyl-substituted succinic acid derived from polypropene (n from about 200 to about 2000, preferably from about 300 to about 1500, more preferably from about 800 to about 1200), acids formed by oxidation of petrolatum or of hydrocarbon waxes, commercially available mixtures of two or more carboxylic acids such as tall oil acids, and rosin acids, octadecyl-substituted adipic acid, chlorostearic acid, 9-methylstearic acid, dichlorostearic acid, stearyl-benzoic acid, eicosane-substituted naphthoic acid, dilauryl-decahydro-naphthalene carboxylic acid, and mixtures of these acids, their metal salts, and/or their anhydrides.

In one embodiment, the carboxylic acids are aromatic carboxylic acids. Examples of aromatic acids include substituted and non-substituted benzoic, phthalic, and salicylic acids. The aromatic carboxylic acids may have a substituent derived from one or more of the above olefins or polyalkenes. The salicylic acids preferably are aliphatic hydrocarbyl substituted salicylic acids. Overbased salts prepared from such salicylic acids with an aliphatic hydrocarbon substituent derived from the above-described polyalkenes, particularly those having average carbon contents from about 50 to about 400 carbon atoms based on number average molecular weight. The above aromatic carboxylic acids are well known or can be prepared according to procedures known in the art. Carboxylic acids of the type illustrated by these formulae and processes for preparing their neutral and basic metal salts are well known and disclosed, for example, in U.S. Pat. Nos. 2,197,832; 2,197,835; 2,252,662; 2,252,664; 2,714,092; 3,410,798; and 3,595,791.

The sulfonic acids may be aliphatic or aromatic sulfonic acids. In one embodiment, the sulfonic acids are mono-, di-, and tri-hydrocarbyl substituted aromatic sulfonic acids. The hydrocarbyl substituent may be derived from any of the above-described olefins or polyalkenes, or oligomers of the above described olefins. Alkyl-substituted benzene sulfonic acids wherein the alkyl group contains at least 8 carbon atoms, including dodecyl benzene "bottoms" sulfonic acids, are particularly useful. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

A group of useful sulfonic acids are mono-, di-, and tri-alkylated benzene and naphthalene (including hydrogenated forms thereof) sulfonic acids. Illustrative of the synthetically produced alkylated benzene and naphthalene sulfonic acids are those containing alkyl substituents having from about 8 to about 30 carbon atoms, preferably from about 12 to about 30 carbon atoms, and advantageously about 24 carbon atoms.

In one embodiment, the phosphorus containing acid is the reaction product of one or more of above polyalkenes and phosphorus sulfides. The phosphorus-containing acids are described in U.S. Pat. No. 3,232,883, issued to LeSuer. This reference is herein incorporated by reference for its disclosure to the phosphorus-containing acids and methods for preparing the same. The phenols useful in making the overbased salts may be represented by the formula $(R_1)_a$—Ar—$(OH)_b$ wherein $R_1$ is derived form the above described olefins or polyalkenes; a and b are independently numbers of at least one, the sum of a and b being in the range of two up to the number of displaceable hydrogens on the aromatic nucleus or nuclei of Ar. Preferably, a and b are independently numbers in the range from 1 to about 4, more preferably from 1 to about 2. $R_1$ and a are preferably such that there is an average of at least about 8 aliphatic carbon atoms provided by the $R_1$ groups for each phenol compound.

The promoters, that is, the materials which facilitate the incorporation of the excess metal into the overbased material, are also quite diverse and well known in the art. A particularly comprehensive discussion of suitable promoters is found in U.S. Pat. Nos. 2,777,874; 2,695,910; 2,616,904; 3,384,586; and 3,492,231. These patents are incorporated by reference for their disclosure of promoters. Acidic materials, which are reacted with the mixture of acidic organic compound, promoter, metal compound and reactive medium, are also disclosed in the above cited patents, for example, U.S. Pat. No. 2,616,904. Included within the known group of useful acidic materials are liquid acids, such as formic acid, acetic acid, nitric acid, boric acid, sulfuric acid, hydrochloric acid, hydrobromic acid, carbamic acid, substituted carbamic acids, etc. Acetic acid is a very useful acidic material although inorganic acidic compounds, such as HCl, $SO_2$, $SO_3$, $CO_2$, $H_2S$, $N_2O_3$, etc., are ordinarily employed as the acidic materials. Preferred acidic materials are carbon dioxide and acetic acid, more preferably carbon dioxide.

Methods for preparing the overbased compositions as well as an extremely diverse group of overbased compositions are disclosed in the following U.S. Pat. Nos. 2,616,904; 2,616,905; 2,616,906; 3,242,080; 3,250,710; 3,256,186; 3,274,135; 3,492,231; and 4,230,586. The disclosures in these patents relating to overbasing procedures, materials which can be overbased, metal bases, promoters, and acidic materials are incorporated herein by reference.

Borated overbased compositions, lubricating compositions containing the same and methods of preparing borated overbased compositions are found in U.S. Pat. No. 4,744, 920, issued to Fischer et al; U.S. Pat. No. 4,792,410, issued to Schwind et al; and PCT Publication WO88103144. The disclosures relating to the above are hereby incorporated by reference.

The following examples relate to borated overbased metal salts and methods of making the same.

EXAMPLE B-5

(a) A mixture of 853 grams of methyl alcohol, 410 grams of blend oil, 54 grams of sodium hydroxide, and a neutralizing amount of additional sodium hydroxide is prepared. The amount of the latter addition of sodium hydroxide is dependent upon the acid number of the subsequently added sulfonic acid. The temperature of the mixture is adjusted to 49° C. A mixture (1070 grams) of straight chain dialkyl benzene sulfonic acid (Mw=430) and blend oil (42% by weight active content) are added while maintaining the temperature at 49–57° C. Polyisobutenyl ($\overline{M}$n=950-) substituted succinic anhydride (145 grams) are added to the reaction vessel along with 838 grams of sodium hydroxide. The temperature is adjusted to 71° C. The reaction mixture is blown with 460 grams of carbon dioxide. The mixture is flash stripped to 149° C., and filtered to clarity to provide the desired product. The product is an overbased sodium sulfonate having a base number (bromophenol blue) of 440, a metal content of 19.45% by weight, a metal ratio of 20, a sulfate ash content of 58% by weight, and a sulfur content of 1.35% by weight.

(b) A mixture of 1000 grams of the product from Example B-5(a) above, 0.13 gram of an antifoaming agent (kerosene solution of Dow Corning 200 Fluid having a viscosity of 1000 cSt at 25° C.), and 133 grams of blend oil is heated to 74–79° C. with stirring. Boric acid (486 grams) is added and the reaction mixture is heated to 121° C. to liberate water of reaction and 40–50% by weight of the $CO_2$ contained in the product from Example 5(a). The reaction mixture is heated to 154–160° C. and maintained at that temperature until the free and total water contents are reduced to 0.3% by weight or less and approximately 1–2% by weight, respectively. The reaction product is cooled to room temperature and filtered. The filtrate has 6.1% boron, 14.4% sodium, and 35% 100 neutral mineral oil.

EXAMPLE B-6

(a) A mixture of 1000 grams of a primarily branched chain monoalkyl benzene sulfonic acid (Mw=500), 771 grams of o-xylene, and 75.2 grams of polyisobutenyl $\overline{M}$n=950 succinic anhydride is prepared and the temperature is adjusted to 46° C. Magnesium oxide (87.3 grams), acetic acid (35.8 grams), methyl alcohol (31.4 grams) and water (59 grams) are added to the reaction vessel. The reaction mixture is blown with 77.3 grams of carbon dioxide at a temperature of 49–54° C. An additional, 87.3 grams of magnesium oxide, 31.4 grams of methyl alcohol and 59 grams of water are added, and the reaction mixture is blown with 77.3 grams of carbon dioxide at 49–54° C. The foregoing steps of magnesium oxide, methyl alcohol and water addition, followed by carbon dioxide blowing are repeated once. O-xylene, methyl alcohol and water are removed from the reaction mixture using atmospheric and vacuum flash stripping. The reaction mixture is cooled and filtered to clarity. The product is an overbased magnesium sulfonate having a base number (bromophenol blue) of 400, a metal content of 9.3% by weight, a metal ratio 14.7, a sulfate ash content of 46.0%, and a sulfur content of 1.6% by weight.

(b) A mixture of 1000 grams of the product from Example B-6(a) and 181 grams of diluent oil is heated to 79° C. Boric acid (300 grams) is added and the reaction mixture is heated to 124° C. over a period of 8 hours. The reaction mixture is maintained at 121–127° C. for 2–3 hours. A nitrogen sparge is started and the reaction mixture is heated to 149° C. to remove water until the water content is 3% by weight or less. The reaction mixture is filtered to provide the desired product. The product contains 7.6% magnesium and 4.3% boron.

EXAMPLE B-7

(a) A reaction vessel is charged with 281 parts (0.5 equivalent) of a polybutenyl-substituted succinic anhydride derived from a polybutene ($\overline{M}$n=1000), 281 parts of xylene, 26 parts of tetrapropenyl substituted phenol and 250 parts of 100 neutral mineral oil. The mixture is heated to 80° C. and 272 parts (3.4 equivalents) of an aqueous sodium hydroxide solution are added to the reaction mixture. The mixture is blown with nitrogen at 1 scfh (standard cu. ft/hr) and the reaction temperature is increased to 148° C. The reaction mixture is then blown with carbon dioxide at 1 scfh for one hour and 25 minutes while 150 parts of water is collected. The reaction mixture is cooled to 80° C. where 272 parts (3.4 equivalents) of the above sodium hydroxide solution is added to the reaction mixture and the mixture is blown with nitrogen at 1 scfh. The reaction temperature is increased to 140° C. where the reaction mixture is blown with carbon dioxide at 1 scfh for 1 hour and 25 minutes while 150 parts of water is collected. The reaction temperature is decreased to 100° C. and 272 parts (3.4 equivalents) of the above sodium hydroxide solution is added while blowing the mixture with nitrogen at 1 scfh. The reaction temperature is increased to 148° C. and the reaction mixture is blown with carbon dioxide at 1 scfh for 1 hour and 40 minutes while 160 parts of water is collected. The reaction mixture is cooled to 90° C. and where 250 parts of 100 neutral mineral oil are added to the reaction mixture. The reaction mixture is vacuum stripped at 70° C. and the residue is filtered through diatomaceous earth. The filtrate contains 50.0% sodium sulfate ash (theoretical 53.8%) by ASTM D-874, total base number of 408, a specific gravity of 1.18 and 37.1% oil.

(b) A reaction vessel is charged with 700 parts of the product of Example B-7(a). The reaction mixture is heated to 75° C. where 340 parts (5.5 equivalents) of boric acid is added over 30 minutes. The reaction mixture is heated to 110° C. over 45 minutes and the reaction temperature is maintained for 2 hours. A 100 neutral mineral oil (80 parts) is added to the reaction mixture. The reaction mixture is blown with nitrogen at 1 scfh at 160° C. for 30 minutes while 95 parts of water is collected. Xylene (200 parts) is added to the reaction mixture and the reaction temperature is maintained at 130–140° C. for 3 hours. The reaction mixture is vacuum stripped at 150° C. and 20 millimeters of mercury. The residue is filtered through diatomaceous earth. The filtrate contains 5.8% boron (theoretical 6.4) and 33.1% oil. The residue has a total base number of 309.

In one embodiment, the boron antiwear or extreme pressure agent is an alkali or an alkali metal and alkaline earth metal borate. These metal borates are generally a hydrated particulate metal borate which are known in the art. Alkali metal borates include mixed alkali and alkaline metal borates. These metal borates are available commercially. Representative patents disclosing suitable alkali and alkali metal and alkaline earth metal borates and their methods of manufacture include U.S. Pat. Nos. 3,997,454; 3,819,521; 3,853,772; 3,907,601; 3,997,454; and 4,089,790. These patents are incorporated by reference for their disclosures of the metal borates and methods of their manufacture.

In another embodiment, the boron antiwear or extreme pressure agent is a borated fatty amine. The borated amines are prepared by reacting one or more of the above boron compounds with one or more of the above fatty amines, e.g., an amine having from about four up to about eighteen carbon atoms. The borated fatty amines are prepared by reacting the amine with the boron compound from about 50° C. to about 300° C., preferably from about 100° C. to about 250° C., and at a ratio from about 3:1 to about 1:3 equivalents of amine to equivalents of boron compound.

In another embodiment, the boron antiwear or extreme pressure agent is a borated epoxide. The borated fatty epoxides are generally the reaction product of one or more of the above boron compounds with at least one epoxide. The epoxide is generally an aliphatic epoxide having from 8 up to about 30, preferably from about 10 up to about 24, more preferably from about 12 up to about 20 carbon atoms. Examples of useful aliphatic epoxides include heptyl epoxide, octyl epoxide, oleyl epoxide and the like. Mixtures of epoxides may also be used, for instance commercial mixtures of epoxides having from about 14 to about 16 carbon atoms and from about 14 to about 18 carbon atoms. The borated fatty epoxides are generally known and are disclosed in U.S. Pat. No. 4,584,115. This patent is incorporated by reference for its disclosure of borated fatty epoxides and methods for preparing the same.

In one embodiment, the boron antiwear or extreme pressure agent is a borate ester. The borate esters may be prepared by reacting of one or more of the above boron compounds with one or more alcohols, such those disclosed above.

In another embodiment, borate ester is a borated phospholipid. The borated phospholipids are prepared by reacting a combination of a phospholipid and a boron compound. Optionally, the combination may include an amine, an acylated nitrogen compound, a carboxylic ester, a Mannich reaction product, or a neutral or basic metal salt of an organic acid compound. These additional components are described above. Phospholipids, sometimes referred to as phosphatides and phospholipins, may be natural or synthetic. Naturally derived phospholipids include those derived from fish, fish oil, shellfish, bovine brain, chicken egg, sunflowers, soybean, corn, and cottonseeds. Phospholipids may be derived from microorganisms, including blue-green algae, green algae, and bacteria.

The reaction of the phospholipid and the boron compound usually occurs at temperature from about 60° C. up to about 200° C., or from about 90° C., or up to about 150° C. The reaction is typically accomplished in about 0.5 up to about 10 hours. The boron compound and phospholipid are reacted at an equivalent ratio of boron to phosphorus of 1–6:1 or 2–4:1, or 3:1. When the combination includes additional components (e.g. amines, acylated amines, neutral or basic meal salts, etc.), the boron compound is reacted with the mixture of the phospholipid and one or more optional ingredients in an amount of one equivalent of boron to an equivalent of the mixture of a phospholipid and an optional ingredient in a ratio from about one, or about two up to about six, to about four to one. The equivalents of the mixture are based on the combined equivalents of phospholipid based on phosphorus and equivalents of the optional ingredients.

Lubricants

As previously indicated, the metal-free thiophosphoric acid esters and their salts are useful in lubricants where they can function primarily as antiwear, antiweld, antiscuff, extreme pressure, and/or rust inhibiting agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in natural gas engines, stationary power engines and turbines and the like. Automatic or manual transmission fluids, transaxle lubricants, gear lubricants, both for open and enclosed systems, tractor lubricants, metal-working lubricants, hydraulic fluids and other lubricating oil and grease compositions can also benefit from the incorporation therein of the compositions of the present invention. They may also be used in lubricants for wirerope, walking cam, slideway, rock drill, chain and conveyor belt, worm gear, bearing, and rail and flange applications. In one embodiment, the lubricants contain less than 3% by weight water, preferable less than 2% by weight water.

The thiophosphorus acid esters and their salts may be used in lubricants or in concentrates. The concentrate contains the thiophosphorus acid esters and/or their salts alone or in combination with other components used in preparing fully formulated lubricants. The concentrate also contains a substantially inert organic diluent, which includes kerosene, mineral distillates, or one or more of the oils of lubricating viscosity discussed below. In one embodiment, the concentrates contain from 0.01% up to about 90%, or from about 0.1% up to about 80%, or from about 1% up to about 70% by weight of the thiophosphorus acid esters or their salts. These compositions may be present in a final product, blend or concentrate in any amount effective to act as an antiwear agent, extreme pressure agent and/or antirust agent in lubricating compositions. The thiophosphorus acid esters or their salts are preferably present in an amount from about 0.001% up to about 10%, or from about 0.01% up to about 5%, or from about 0.1% up to about 4% by weight. In one embodiment, when the thiophosphorus acid ester or their salts are used in oils, such as gear oils, they are preferably present in an amount from about 0.1% up to about 8%, or from about 0.5% up to 5%, or from about 0.5% up to about 3% by weight of the lubricating composition. When the thiophosphorus acid esters or their salts are used in functional fluids, such as hydraulic fluids, they are generally present in an amount from about 0.001% up to about 10%, or from about 0.01% up to about 5%, or from about 0.2% to about 2% by weight of the functional fluid. The inventors have discovered that the thiophosphorus acid esters and/or their salts act as both antiwear or extreme pressure agent and an antirust agent.

The lubricating compositions and methods of this invention employ an oil of lubricating viscosity. The oil of lubricating viscosity is generally present in a major amount (i.e. an amount greater than about 50% by weight). In one embodiment, the oil of lubricating viscosity is present in an amount greater than about 60%, or greater than about 70%, or greater than about 80% by weight of the composition. The oils of lubricating viscosity include natural or synthetic lubricating oils and mixtures thereof. Natural oils include animal oils, vegetable oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Unrefined, refined, and rerefined oils, either natural or synthetic, may be used in the compositions of the present invention. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity is a polyalpha-olefin (PAO). Typically, the polyalpha-olefins are derived from monomers having from about 3 to about 30, or from about 4 to about 20, or from about 6 to about 16 carbon atoms. Examples of useful PAOs include those derived from decene. These PAOs may have a viscosity from about 3 to about 150, or from about 4 to about 100, or from about 4 to about 8 cSt at 100° C. Examples of PAOs include 4 cSt polyolefins, 6 cSt polyolefins, 40 cSt polyolefins and 100 cSt polyalphaolefins.

In one embodiment, the oil of lubricating viscosity are selected to provide lubricating compositions with a kinematic viscosity of at least about 3.5 cSt, or at least about 4.0 cSt at 100° C. In one embodiment, the lubricating compositions have an SAE gear viscosity grade of at least about SAE 75W. The lubricating composition may also have a so-called multigrade rating such as SAE 75W-80, 75W-90, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol 3174 available from The Lubrizol Corporation.

In one embodiment, the oil of lubricating viscosity includes at least one ester of a dicarboxylic acid. Typically the esters containing from about 4 to about 30, preferably from about 6 to about 24, or from about 7 to about 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

Other Additives

The invention also contemplates the use of other additives together with the thiophosphorus acid esters having a hydrocarbyl terminated oxyalkylene group or their salts. Such additives include, for example, detergents and dispersants, corrosion- and oxidation-inhibiting agents, pour point depressing agents, extreme pressure agents, antiwear agents, color stabilizers and anti-foam agents. The dispersant include the above described carboxylic dispersant (e.g. acylated amines and carboxylic esters), amine dispersants, and Mannich dispersants, with and without boron, and post treated dispersants and polymer dispersants.

"Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

"Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Pat. Nos. 3,329,658, 3,449,250, 3,519,656, 3,666,730, 3,687,849, and 3,702,300.

In one embodiment, the lubricating compositions and functional fluids contain one or more auxiliary extreme pressure and/or antiwear agents, corrosion inhibitors and/or oxidation inhibitors. Auxiliary extreme pressure agents and corrosion and oxidation inhibiting agents which may be included in the lubricants and functional fluids of the invention are exemplified by chlorinated aliphatic hydrocarbons, such as chlorinated wax; and metal thiocarbamates, such as zinc dioctyldithiocarbamate, and barium heptylphenyl dithiocarbamate. Many of the above-mentioned auxiliary extreme pressure agents and corrosion-oxidation inhibitors also serve as antiwear agents. In one embodiment, the lubricants are free of metal dithiophosphates, such as zinc dithiophosphates.

The lubricating compositions and functional fluids may contain one or more pour point depressants, color stabilizers, metal deactivators and/or anti-foam agents. Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are herein incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

These additional additives, when used, are present in the inventive lubricating and functional fluid compositions at sufficient concentrations to provide the compositions with enhanced properties depending upon their intended use. Generally, each of these additional additives are present in the lubricants and functional fluids at concentrations from about 0.01%, or from about 0.05%, or from about 0.5%. These additional additives are generally present in an amount up to about 20% by weight, or up to about 10% by weight, and or up to about 3% by weight.

The following examples relate to lubricants containing the thiophosphrus acid esters.

EXAMPLE I

A gear oil composition is prepared by incorporating 6% by weight of the product of Example 1 in a 75W-90 base fluid.

EXAMPLE II

A crankcase lubricant is prepared by incorporating 1.5% by weight of the product of Example 2 in a 10W-30 base fluid.

EXAMPLE III

A lubricant is prepared by incorporating 3% by weight of the product of Example 1 and 3.2% by weight of the product of Example S-1 in a 75W-90 base fluid.

EXAMPLE IV

A lubricant is prepared as described in Example III except 2.7% by weight of the reaction product of carbon disulfide, butylamine and methylacrylate is used in place of the product of Example S-1.

The following chart relates to Examples V-XII which are lubricants that are prepared by incorporating the individual components and an 80W-90 base fluid.

| | V | VI | VII | VIII | IX | X | XI | XII | XIII |
|---|---|---|---|---|---|---|---|---|---|
| Prod. of Ex. 1 | — | — | — | — | — | 3 | — | — | — |
| Prod. of Ex. 2 | 3.2 | — | 1.5 | — | 2.9 | — | — | — | 3 |
| Prod. of Ex. 9 | — | 2.8 | — | — | — | — | 2.1 | — | — |
| Prod. of Ex. 10 | — | — | — | 3.1 | — | — | — | 2 | — |
| Prod. of Ex. S-1 | — | 3.2 | — | — | 3.2 | 3.2 | 3.2 | 3.2 | 3.2 |
| Prod. of Ex S-4 | — | — | 3.2 | — | — | — | — | — | — |
| Dibutyl phosphite | — | 0.8 | 0.5 | — | — | — | — | — | — |
| Triphenyl thiophosphate | — | — | 0.5 | — | — | — | — | — | — |
| Prod. of Ex. B-2 | 1.2 | — | 0.9 | — | 0.8 | — | — | — | 0.9 |
| Prod. of Ex. B-4 | — | 1.1 | — | 0.9 | — | — | — | — | — |

EXAMPLES XIV–XVII

To each of above Examples X–XIII is added 0.15% of a reaction product of $C_{12}$ alkyl phenol, formaldehyde and dimercaptothiadiazole, 0.35% of oleylamine, 0.1% of oleylamide, and 0.08% of an ethylacrylate, 2-ethylhexyl acrylate copolymer pour point depressant.

EXAMPLE XVIII

A lubricant is prepared by incorporating 0.6% by weight of ditertiary butylphenol, 0.3% by weight of dinonyidiphenylamine, 0.6% by weight of the product of Example 1, 0.05% by weight of a reaction product of tolytriazole, paraformaldehyde and di(2-ethylhexylamine), and 0.01% of a polysiloxane foam inhibitor into a base fluid comprising 70% by volume Sunyl 80 and 30% TMP trioleate.

Grease

Where the lubricant is to be used in the form of a grease, the lubricating oil generally is employed in an amount sufficient to balance the total grease composition and, generally, the grease compositions will contain various quantities of thickeners and other additive components to provide desirable properties. The thiophosphorus compounds are present in an amount from about 0.5%, or from about 1% by weight. The hydroxyalkyl dithiocarbamates and borates thereof may be used in an amount up to about 10%, or to about 5% by weight.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmitic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners. Useful thickeners include hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like.

EXAMPLE G-1

A grease is prepared by incorporating-1.3% by weight of the product of Example 2 and 1.3% by weight of the product of Example S-1 into a Southwest Petro-chem Lithium 12 hydroxy base grease.

EXAMPLE G-2

A grease is prepared by incorporating 0.7% by weight of the product of Example 7, 1.3% by weight of the product of Example S-1, 0.7% by weight of dibutyl phosphite, and 0.03% by weight of tolyltriazole into a Southwest Petro-Chem Lithium 12 hydroxy base grease.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating composition comprising a major amount of an oil of lubricating viscosity and at least one metal-free thiophosphorus acid ester, at least one amine salt of the thiophosphorus acid ester, or a mixture thereof, wherein the thiophosphorus acid ester contains at least one hydrocarbyl terminated oxyalkylene group, at least one hydrocarbyl terminated polyoxyalkylene group, or a mixture thereof.

2. The composition of claim 1 wherein the hydrocarbyl moiety contains up to about 30 carbon atoms.

3. The composition of claim 1 wherein the hydrocarbyl moiety is selected from the group consisting of butyl, octyl, dodecyl, stearyl, and oleyl.

4. The composition of claim 1 wherein the oxyalkylene moiety contains from 1 to about 18 carbon atoms.

5. The composition of claim 1 wherein the oxyalkylene moiety is selected from the group consisting of oxyethylene, oxypropylene, oxybutylene, and mixtures thereof.

6. The composition of claim 1 wherein the hydrocarbyl terminated polyoxyalkylene group contains from 1 to about 40 oxyalkylene moieties.

7. The composition of claim 1 wherein the hydrocarbyl terminated polyoxyalkylene group contains from 2 to about 12 oxyalkylene moieties.

8. The composition of claim 1 wherein the thiophosphorus acid ester has at least two selected from the group consisting of a hydrocarbyl terminated oxyalkylene group and a hydrocarbyl terminated polyoxyalkylene group.

9. The composition of claim 1 wherein the salt of thiophosphorus acid ester is derived from at least one amine.

10. The composition of claim 9 wherein the amine is at least one tertiary aliphatic primary amine.

11. The composition of claim 1 wherein the lubricating composition further comprises at least one sulfur compound, or at least one phosphorous or boron containing antiwear or extreme pressure agent.

12. A lubricating composition comprising a major amount of an oil of lubricating viscosity and at least one metal-free monothiophosphorus acid ester containing at least one hydrocarbyl terminated oxyalkylene group or at least one hydrocarbyl terminated polyoxyalkylene group, or at least one amine salt of the monothiophosphorus acid ester.

13. The composition of claim 12 wherein the hydrocarbyl moiety contains up to about 30 carbon atoms, wherein the oxyalkylene moiety contains from 1 to about 18 carbon atoms, and wherein the hydrocarbyl terminated polyoxyalkylene group contains from about 2 to about 40 oxyalkylene moieties.

14. A lubricating composition comprising a major amount of an oil of lubricating viscosity and at least one metal-free thiophosphorus acid ester represented by the following formula $$(R_1\text{—}(OR_2)_x\text{—}X_2)_{3-a}\text{—}\overset{\overset{X_1}{\|}}{P}\text{—}(X_3R_3)_a$$

wherein $X_1$, $X_2$, and $X_3$ are oxygen or sulfur, provided that at least one of $X_1$, $X_2$, and $X_3$ is sulfur; $R_1$ is a hydrocarbyl group; $R_2$ is an alkylene group; $R_3$ is hydrogen or a hydrocarbyl group; x is a number from 1 to about 40; and a is 0, 1, or 2, or at least one salt of the thiophosphorus acid ester.

15. The composition of claim 14 wherein $R_1$ and $R_3$ each independently contain up to about 30 carbon atoms.

16. The composition of claim 14 wherein $R_2$ contains from 1 to about 18 carbon atoms.

17. The composition of claim 14 wherein $X_1$ is sulfur, and $X_2$ and $X_3$ are oxygen, and a is 0 or 1.

18. The composition of claim 14 wherein x is a number from 2 to about 10.

19. The composition of claim 14 wherein the salt is at least one amine salt and $R_3$ is hydrogen.

20. The composition of claim 14 wherein the lubricating composition further comprises at least one sulfur compound, or at least one phosphorous or boron antiwear or extreme pressure agent.

21. A lubricating composition comprising a major amount of an oil of lubricating viscosity and at least one thiophosphorus acid ester represented by the following formula $$(R_1\text{—}(OR_2)_x\text{—}O)_{3-a}\text{—}\overset{\overset{S}{\|}}{P}\text{—}(OR_3)_a$$

wherein $R_1$ is a hydrocarbyl group; R2 is an alkylene group; $R_3$ is hydrogen or a hydrocarbyl group; x is a number from 1 to about 40; and a is 0, 1, or 2, or at least one salt of the thiophosphorus acid ester.

22. The composition of claim 21 wherein $R_1$ and $R_3$ each independently contain up to about 30 carbon atoms, $R_2$ contains from 1 to about 18 carbon atoms, and x is a number from 2 to about 10.

23. The composition of claim 21 wherein the salt is at least one amine salt, and $R_3$ is hydrogen.

24. The composition of claim 21 wherein the lubricating composition further comprises at least one sulfur compound, or at least one phosphorous or boron containing antiwear or extreme pressure agent.

25. The composition of claim 21 wherein the lubricating composition is a metal working fluid, a hydraulic fluid, or an automatic transmission fluid.

26. A gear oil composition comprising a major amount of gear oil base fluid and at least one metal-free thiophosphorus acid ester containing at least one hydrocarbyl terminated oxyalkylene group or at least one hydrocarbyl terminated polyoxyalkylene group, or at least one salt of the thiophosphorus acid ester.

27. The composition of claim 26 wherein the thiophosphorus acid ester is represented by the following formula $$(R_1\text{—}(OR_2)_x\text{—}X_2)_{3-a}\text{—}\overset{\overset{X_1}{\|}}{P}\text{—}(X_3R_3)_a$$

wherein $X_1$, $X_2$, and $X_3$ are independently oxygen or sulfur, provided that at least one of $X_1$, $X_2$, and $X_3$ is sulfur; $R_1$ is a hydrocarbyl group; $R_2$ is an alkylene group; $R_1$ is hydrogen or a hydrocarbyl group; x is a number from 1 to about 40; and a is 0, 1, or 2.

28. The composition of claim 26 wherein the lubricating composition further comprises at least one sulfur compound, or at least one phosphorous or boron containing antiwear or extreme pressure agent.

29. A grease composition comprising an oil of lubricating viscosity, at least one thickener, and at least one metal-free thiophosphorus acid ester containing at least one hydrocarbyl terminated oxyalkylene group or at least one polyoxyalkylene group, or at least one amine salt of the thiophosphorus acid ester.

30. A concentrate comprising a substantially inert, organic diluent and from 0.1% to about 99% by weight of at least one metal-free thiophosphorus acid ester containing at least one hydrocarbyl terminated oxyalkylene group or at least one polyoxyalkylene group, or at least one amine salt of the thiophosphorus acid ester.

31. A lubricating composition comprising a major amount of an oil of lubricating viscosity and at least one metal-free thiophosphorus acid ester having three pendant groups selected from the group consisting of hydrocarbyl terminated oxyalkylene group, hydrocarbyl terminated polyoxyalkylene groups or mixtures thereof.

32. The composition of claim 31 wherein the thiophosphorus acid ester is used in combination with at least one metal-free thiophosphorus acid ester containing 1 or 2 hydrocarbyl terminated oxyalkylene groups, hydrocarbyl terminated polyoxyalkylene groups, or a mixture thereof.

33. The composition of claim 31 further comprising a corrosion or oxidation inhibiting agent.

* * * * *